US005564984A

United States Patent [19]

Mirabella et al.

[11] Patent Number: 5,564,984

[45] Date of Patent: Oct. 15, 1996

[54] DOUBLE HULL AMUSEMENT RIDE VEHICLE

[75] Inventors: Albert Mirabella, Canoga Park; Joel L. Fritsche, Studio City; James K. Wallace, Long Beach, all of Calif.; Timothy V. Kelley, Clermont, Fla.

[73] Assignee: The Walt Disney Company, Burbank, Calif.

[21] Appl. No.: 315,115

[22] Filed: Sep. 29, 1994

[51] Int. Cl.[6] ..... A63G 1/00

[52] U.S. Cl. ..... 472/43; 472/26; 414/921

[58] Field of Search ..... 472/43, 2, 131, 472/13, 26, 48, 135, 137, 34; 414/921, 495; 14/69, 70; 104/77, 78, 58; 105/164

[56] References Cited

U.S. PATENT DOCUMENTS

| | | | |
|---|---|---|---|
| 2,617,547 | 11/1952 | Pridy | 414/495 X |
| 2,992,598 | 7/1961 | Einfalt | 104/58 X |
| 3,397,649 | 8/1968 | Pfeffer | 104/28 |
| 3,419,164 | 12/1968 | O'Neill | 414/495 X |
| 3,537,745 | 11/1970 | Herring, Jr. | 414/495 X |
| 5,105,915 | 4/1992 | Gary | 414/921 X |
| 5,328,320 | 7/1994 | Farrow et al. | 414/495 |
| 5,388,937 | 2/1995 | Farsai | 414/921 X |

*Primary Examiner*—Kien T. Nguyen
*Attorney, Agent, or Firm*—Hecker & Harriman

[57] ABSTRACT

A vehicle that provides safe and stable transportation of passengers, yet allows passengers, including wheelchair-bound passengers, to quickly enter and exit the vehicle without climbing up or down and without stepping on the seats has been provided. The preferred embodiment of the vehicle of the present invention, which is towed by an underwater cable system, has a double hull construction with a fixed outer hull and a moveable inner hull or seating platform, which may be raised or lowered. In the ride dispatch area, the inner hull is raised so that the floor of the inner hull is even with that of the vehicle gunwales and the dispatch floor level. During the ride, the hull is lowered so that the floor of the inner hull is below the level of the vehicle gunwales, and thus the vehicle forms a secure and stable seating compartment configuration for the duration of the ride. The vehicle is further equipped to secure wheelchair-bound guests to the inner hull quickly and easily.

5 Claims, 18 Drawing Sheets

DOUBLE HULL AMUSEMENT RIDE VEHICLE

BACKGROUND OF THE INVENTION

1. Field of the Invention

The present invention relates to amusement ride vehicles.

2. Background Art

Amusement ride vehicles must safely and securely carry passengers, yet allow easy ingress and egress of passengers. Prior art amusement ride vehicles have not effectively provided the above combination of characteristics.

Typically, in the prior art, a guest entering a vehicle must step up, down, or over a threshold from the loading platform into the seating area, by either stepping into the bottom of the vehicle, on a step within the vehicle, or on the vehicle seat. Usually a hand rail or some other means of support is needed to assist the guest. To exit the vehicle, the guest needs to step up or down to a platform, again generally requiring the use of a handrail or other means of support. Small children or physically disabled guests might need further assistance to enter or exit the vehicle. Furthermore, some guests find it objectionable to sit on seats on which they must first step to board a ride vehicle or on which other guests have stepped to exit the vehicle. Also, the threshold may pose a hazard for guests of tripping, stumbling, or slipping.

For guests in wheelchairs entering the vehicle, many prior art vehicles required that the guest be lifted into the vehicle and then secured with a number of belts. An alternative method of loading and unloading wheelchair-bound guests in prior art amusement ride water vehicles required the use of ramps. The drawbacks of these procedures include that they are time consuming, cause unwanted attention to be drawn to the wheelchair-bound guest, and may result in the guest being jostled.

U.S. Pat. No. 1,230,998, issued to Cramer on Jun. 26, 1917, describes a mechanism for actuating the seats of carousels or merry-go-rounds and particularly for imparting a forward and backward as well as vertical motion to the figures of horses and other animals. One of the objects is to provide an improved actuating mechanism by which the forward and backward movement of the figures is augmented in order to render their motion more realistic and amusing, without however increasing their vertical motion to such an extent that they can not be conveniently mounted when in their highest position. The Cramer patent does not describe a double hull amusement park ride vehicle.

U.S. Pat. No. 1,412,969, issued to Sachs on Apr. 18, 1922, describes a conveyor belt system for the movement of passengers or freight that provides loading and unloading stations where the acceleration and retardation of the passengers or freight, after being once initiated, is accomplished automatically by longitudinal movement rather than by lateral movement from one surface to another surface traveling at a different speed. The acceleration or retardation takes place in the direction of travel. The Sachs patent does not describe a double hull amusement park ride vehicle.

U.S. Pat. No. 1,440,661, issued to Dickinson on Jan. 2, 1923, describes an amusement device by means of which passengers may ride in a floating vehicle supported solely by the water and propelled therein in such a manner as to give peculiar and entertaining sensations. An object is to provide means whereby the several parts of the operating mechanism may be raised to view for the purpose of inspection whenever desired. The Dickinson patent does not describe a double hull amusement park ride vehicle.

U.S. Pat. No. 2,235,563, issued to Ridgway on Mar. 18, 1941, describes an amusement park boat ride in which each boat is adapted to carry passengers, and is arranged to be propelled or drawn in a tank or runway of water. The boats are provided with the capability of effecting a jumping or leaping action and simulating a high-speed motor craft. The Ridgway patent does not describe a double hull amusement park ride vehicle.

U.S. Pat. No. 3,404,635, issued to Bacon, et al. on Apr. 16, 1965, describes a passenger-carrying boat amusement park ride having a continuous waterway with a section that is bifurcated to define first and second branches, each of the branches being provided with a passenger loading station. The apparatus includes an upwardly inclined ramp which raises the boats onto a discharge conveyor with the latter supporting the boats in a non-buoyant condition that eliminates any tipping of the boats during passenger loading and unloading. After the boats are loaded they return to the waterway by means of a downwardly inclined ramp. The Bacon, et al. patent does not describe a double hull amusement park ride vehicle.

U.S. Pat. No. 3,515,074, issued to Helbig on Jun. 2, 1970, describes equipment for rapid loading, transporting and unloading of skiers and other passengers, comprising a loading structure and a motor vehicle, in which the loading structure is provided with a plurality of parallel separate aisles each provided with an entrance and means for admitting only a predetermined number of passengers. The Helbig patent does not describe a double hull amusement park ride vehicle.

U.S. Pat. No. 3,964,316, issued to Abe on Jun. 22, 1976, describes an apparatus to generate a wave-like pattern of forces on a surface effect ship that utilizes a flexible membrane which undulates in a water wave-like manner, the crests of the waves transferring forces to the surface effect ship. This apparatus permits ships of various designs to be tested for habitability and performance characteristics without the expense and bother of having the ship placed in the water. The Abe patent does not describe a double hull amusement park ride vehicle.

U.S. Pat. No. 4,063,517, issued to Nardozzi on Dec. 20, 1977, describes a mass transit system using an endless water way supported by a superstructure and including a bottom wall and side walls extending upwardly from the bottom wall to form a trough. The continuous forward movement of water in the waterway forwardly propels the vehicles from station to station. Conveyor devices transport the vehicles through the station at a controlled rate of speed to facilitate the boarding and departure of passengers to and from the vehicles. The Nardozzi patent does not describe a double hull amusement park ride vehicle.

U.S. Pat. No. 5,033,392, issued to Schemitch on Jul. 23, 1991, describes an apparatus for loading and unloading passengers from watercraft, such as for use in boat rides at amusement parks, including a substantially planar inclined platform mounted for rotation about an axis perpendicular to the plane of the platform. Watercraft traveling along a predetermined path are engaged by a section of the rotating platform as it surfaces and are lifted out of the water by the platform as it rotates. The watercraft is disengaged from the rotating platform as the section of the platform on which it rests submerges. The Schemitch patent does not describe a double hull amusement park ride vehicle.

Prior art amusement ride vehicles have been difficult to enter and exit and have not allowed easy access to passengers in wheelchairs. Therefore, an amusement ride vehicle that avoids these disadvantages is needed.

SUMMARY OF THE INVENTION

The present invention provides a double hull amusement ride vehicle that will allow for easy ingress and egress of guests. The present invention allows guests to quickly enter and exit the ride vehicle without climbing up or down into the vehicle and without stepping on the vehicle's seats. The present invention allows safe entry and exit without handrails or similar supports. The present invention also allows guests in wheelchairs to quickly and easily enter and exit the vehicle and allows the wheelchairs to be securely fixed to the vehicle during the ride.

The preferred embodiment of the vehicle of the present invention, which is towed by an underwater cable system, has a double hull construction with a fixed outer hull and a moveable inner hull or seating platform, which may be raised or lowered. In the ride dispatch area, the inner hull is raised so that the floor of the inner hull is even with that of the vehicle gunwales and the dispatch floor level and loading dock. During the ride, the hull is lowered so that the floor of the inner hull is below the level of the vehicle gunwales, and thus the vehicle forms a secure and stable seating compartment configuration for the duration of the ride. The vehicle is further equipped to secure wheelchair-bound guests to the inner hull quickly and easily.

The front and rear interfaces of the two hulls are constructed as linear bearings or sliding guides to allow for smooth sliding movement between the hulls. A pivoting arm arrangement may be used to maintain linear lifting motion over a slanting ramp or cam structure. Alternatively, a multistage ramp or cam arrangement may be used to maintain linear lifting motion without a pivoting arm arrangement. Cables may be used to limit the relative movement between the two hulls.

An underwater cam structure is located in the dispatch area of the ride. The structure, as the vehicle moves in the direction of the ride path, is formed in three sections: an upward sloping ramp section, a long flat section, and a downward sloping ramp section. When the vehicle enters the dispatch area of the ride, the bottom surface of the inner hull contacts the upwardly sloping section of the underwater structure, which causes the inner hull to be gradually raised to a desired level, wherein the floor of the inner hull is on the same level as the vehicle gunwales and the loading dock. The loading dock may be a stationary surface or a moving belt. When the floor of the inner hull of the vehicle is on this level, guests of all sizes and physical abilities can easily enter or exit the vehicle without having to step up or down or use any support means, except for the back of a vehicle seat, if necessary.

The bottom surface of the inner hull may be formed in a variety of structures to achieve its intended purpose. One embodiment comprises a pair of urethane wheels pivotally mounted to the bottom surface and on each side of the vehicle. As the vehicle approaches the dispatch area, the wheels make contact with the upwardly sloping section of the underwater structure and cause the inner hull to slowly rise to its desired level. The underwater structure then flattens out, so that the inner hull is maintained at the desired level while guests enter and exit the ride. In this position, the ride vehicle has a negative buoyancy, thereby further stabilizing it in the dispatch area. At the end of the dispatch area, the wheels contact the downwardly sloping portion of the underwater structure, which causes the inner hull to be gradually lowered into its desired position during the ride. The guest seating compartment formed by the two hulls is secure and stable in this position.

In a second embodiment of the invention, the bottom outer surface of the inner hull has the shape of an inverted, truncated, pyramid. The portion of this surface which contacts the underwater structure located in the dispatch area is covered with a low friction material, preferably ultra high molecular weight (UHMW) plastic.

Guests in wheelchairs easily enter and exit the ride in the dispatch area. Neither ramps nor lifting are required. The vehicle is stabilized by the supporting structure, so it does not heel or trim during loading or unloading of guests. Wheel-chair bound guests are conducted onto the floor of the inner hull seating compartment in the dispatch area from the dock and over the gunwales of the vehicle. Quick disconnect or lockdown devices near each wheel may be quickly put into place, and the guest is secured to the vehicle and the wheelchair to the vehicle. In this position, the wheelchair-bound guest is sitting at or near the same level as the seated guest. During the ride, the ride vehicle is stable because the inner hull is lowered, and no further restraints are required to secure the wheelchair-bound guest. When exiting the ride, the quick disconnect devices are released, allowing for rapid and easy exit of the guest.

The present invention safely and securely carries passengers, including wheelchair-bound passengers, and allows them easy ingress and egress. Thus, the present invention overcomes the disadvantages of the prior art.

DETAILED DESCRIPTION OF THE INVENTION

In the following description, numerous specific details are set forth in order to provide a more thorough understanding of the present invention. It will be apparent, however, to one skilled in the art, that the present invention may be practiced without these specific details. In other instances, well-known features have not been described in detail in order not to unnecessarily obscure the present invention.

Figure 1:
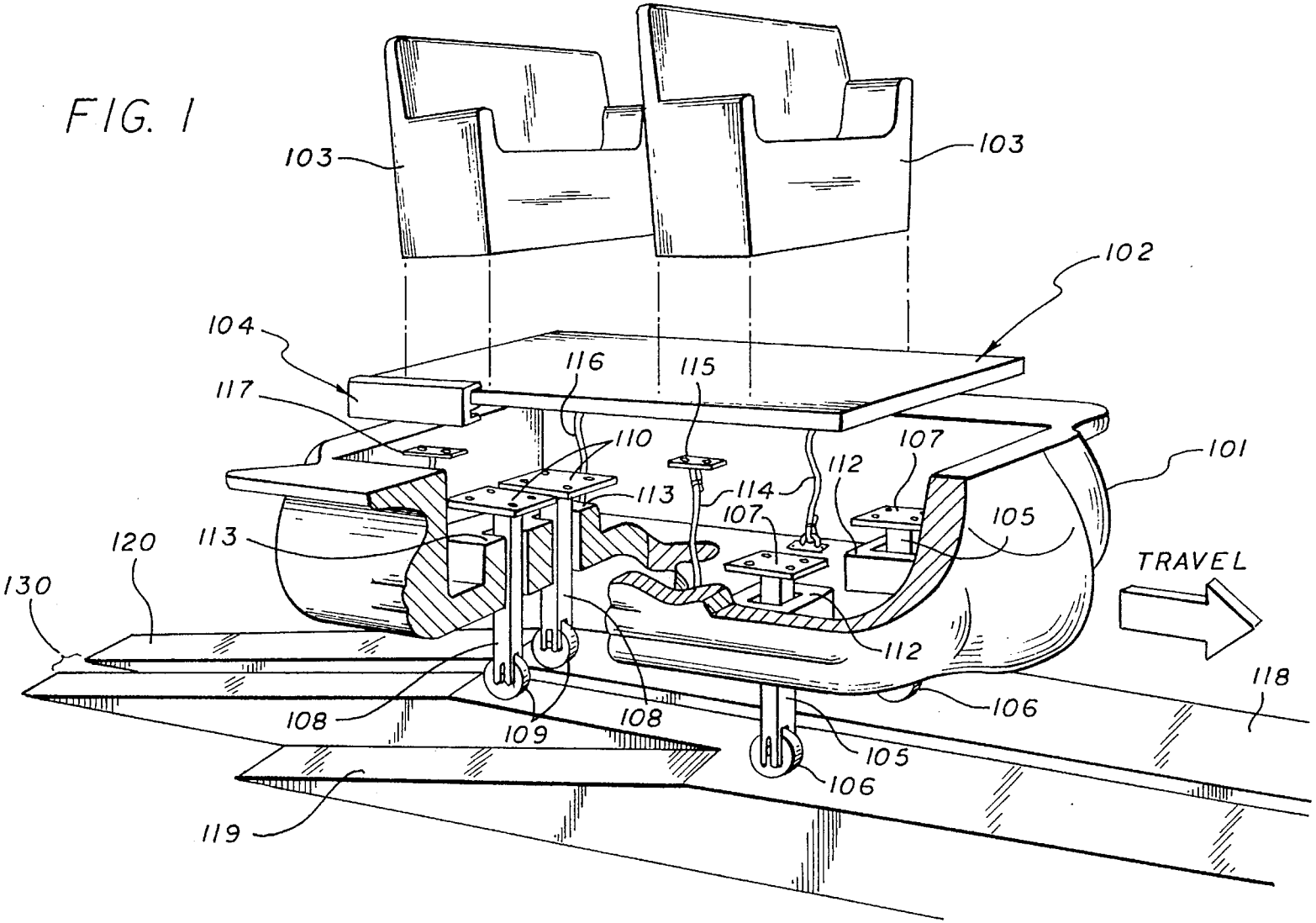
FIG. 1 is a cutaway view of the preferred embodiment of the present invention.

FIG. 1 is a cutaway view of the preferred embodiment of the present invention. The preferred embodiment of the present invention comprises an outer hull assembly, an inner hull assembly, and a platform. The outer hull assembly comprises outer hull 101. The inner hull assembly comprises inner hull 102, seats 103, channel 104, front legs 105, front wheels 106, front mounting plates 107, rear legs 108, rear wheels 109, rear mounting plates 110, front leg hole wells 112, and rear leg hole wells 113.

Cable assemblies comprising front cables 114, front stop plates 115, rear cables 116, and rear stop plates 117 may be used to limit the excursion of the inner hull assembly relative to the outer hull assembly. If the inner hull assembly is lifted beyond a certain height relative to the outer hull assembly, the cables assemblies begin to lift the outer hull assembly along with the inner hull assembly so as to maintain the positions of the inner and outer hull assemblies relative to one another. These cable assemblies assure the same relative position of the inner and outer hull when the inner hull is fully raised relative to the outer hull. In this fully raised position, the upper surfaces of the inner and outer hulls are flush with each other and with the dock. Ramp 118 comprises medial portion 120 and lateral portion 119. Ramp 118 further comprises a slot 130 that passes centrically through ramp 118. Slot 130 provides a conduit for tow cable 132 (not shown in FIG. 1) through ramp 118.

Outer hull 101 is formed of a buoyant material, such as polyethylene or polypropylene, preferably by a rotational molding process. Alternatively, other materials, including non-buoyant materials, may be used. To provide buoyancy, outer hull 101 may be constructed with thin walls, leaving a volume between the thin walls that may be sealed to contain a gas, such as air, or that may be filled with a foam material, such as a closed cell foam, polystyrene foam, polyethylene foam, ethyl vinyl acetate foam, or some other foam that provides buoyancy.

Inner hull 102 is constructed of a strong, stiff material, such as a honeycomb material. Materials such as aluminum, fiberglass, polymers, plywood, balsawood, foam covered with fiberglass or other suitably strong and stiff materials may be used. Channel 104, which is also constructed of a strong, stiff material, is affixed to one or more edges of inner hull 102 to additionally strengthen inner hull 102. Channel 104 is also designed to minimize wear at the interface between the outer and inner hulls and provide a bearing surface.

One or more of seats 103 are mounted upon inner hull 102. Seats 103 are constructed of a material capable of bearing the weight of passengers and providing comfortable seating. Seats 103 may be made of a fiberglass, metal, a polymer material, such as rotationally molded polyethylene or polypropylene, or some other suitable material.

One or more front legs 105 are affixed to and extend downward from inner hull 102. Mounting plates 107 are provided at the upper end of front legs 105 to secure front legs 105 to inner hull 102 and to increase the weight bearing surface area. Wheels 106 are provided at the lower end of front legs 105 to minimize friction. Front legs 105, wheels 106, and mounting plates 107 are constructed of a strong material suitable for long term immersion in water. For example, front legs 105, wheels 106, and mounting plates 107 may be constructed of stainless steel, steel that has been treated to inhibit corrosion, fiberglass, aluminum, composite materials, or other materials with suitable properties.

The leg assembly of the front and rear legs 105 and 108 of the vehicle of the present invention are preferably a square or rectangular tube made of a metal or alloy, such as steel or stainless steel. The legs 105 and 108 are substantially enclosed by wells 112 and 113 extending downward through the hull into the water. As indicated in FIG. 1, the cross-section views of rear wells 113 illustrate that the wells 112 and 113 are raised within the outer hull 101 providing passages enclosing legs 105 and 108 that are significantly longer than the thickness of hull 101. The top surfaces wells 112 and 113 are above the waterline of the vehicle to prevent flooding of the outer hull 101. Because the outer surfaces of legs 105 and 108 communicate tightly with the inner surfaces of wells 112 and 113, water is prevented from flowing through wells 112 and 113 into the interior of outer hull 101.

One or more rear legs 108 are affixed to and extend downward from inner hull 102. Mounting plates 110 are provided at the upper end of rear legs 108 to affix rear legs 108 to inner hull 102 and to increase the load bearing surface area. Wheels 109 are provided at the lower end of rear legs 108 to minimize friction. Rear legs 108, wheels 109, and mounting plates 110 are constructed of a strong material that is suitable for long term immersion in water. For example, Rear legs 108, wheels 109, and mounting plates 110 may be constructed of stainless steel, steel that has been treated to inhibit corrosion, fiberglass, aluminum, composite materials, or other materials with suitable properties. Front legs 105 and rear legs 108 pass through holes in outer hull 101, allowing wheels 106 and 109 to be located below outer hull 101.

An embodiment of a cam structure comprising platform 118 is located at the ride dispatch area. Platform 118 has two portions: medial portion 120 and lateral portion 119. Medial portion 120 is located in the center of the vehicle's path, and lateral portion 119 is located peripheral to medial portion 120 on both sides of medial portion 120. Lateral portion 119 includes an ascending ramp area, a flat area, and a descending ramp area. Medial portion 120 includes an ascending ramp area, a flat area, and a descending ramp area. The distance between the ascending ramp areas of lateral portion 119 and medial portion 120 is equal to the distance between the axial centers of front wheels 106 and rear wheels 109. Similarly, the distance between the descending ramp areas of lateral portion 119 and medial portion 120 is equal to the distance between the axial centers of front wheels 106 and rear wheels 109. This ensures that front wheels 106 and rear wheels simultaneously contact the ascending ramps of lateral portion 119 and medial portion 120 of platform 118, respectively. Similarly, front wheels 106 and rear wheels simultaneously lose contact with the descending ramps of lateral portion 119 and medial portion 120 of platform 118, respectively.

As the vehicle moves toward the ride dispatch area, the bow of the vehicle passes over medial portion 120 and front wheels 106 pass on the sides of medial portion 120. The front legs 105 are spaced wide enough to straddle medial portion 120 and rear legs 108 are spaced so as to contact medial portion 120. As the vehicle progresses further, it encounters lateral portion 119. Front wheels 106 contact the ascending ramp area of lateral portion 119 at the same time as rear wheels 109 contact the ascending ramp area of medial portion 120. As front wheels 106 continue along the ascending ramp area of lateral portion 119, front wheels 106, along with front legs 105, are elevated to the level of the flat area of lateral portion 119. As front wheels 106 are elevated by the ascending ramp area of lateral portion 119, rear wheels 109, along with rear legs 108, are elevated by the ascending ramp area of medial portion 120 so as to ensure simultaneous elevation of both front legs 105 and rear legs 108. As the vehicle travels further, front wheels 106 reach the flat area of lateral portion 119, and rear wheels 109 reach the flat area of medial portion 120. When both front wheels 106 and rear wheels 109 have reached their respective flat areas, inner hull 102 is elevated to its maximum height. The level of inner hull 102 is preferably equal to the level of the gunwales of outer hull 101 and to the level of the dock, allowing easy ingress and egress of passengers. Since both front legs 105 and rear legs 108 are coupled to inner hull 102, the simultaneous elevation of front legs 105 and rear legs 108 results in smooth, even elevation of inner hull 102.

Front cables 114 and rear cable 116 may be used to limit the distance by which outer hull 101 and inner hull 102 may be separated. The upper ends of front cables 114 are attached to plates 115, which are mounted on inner hull 102. The lower ends of front cables 114 are attached to similar plates mounted on outer hull 101. The upper ends of rear cables 116 are attached to plates 117, which are mounted on inner hull 102. The lower ends of rear cables 116 are attached to similar plates mounted on outer hull 101.

As the vehicle continues to travel, front wheels 106 reach the descending ramp area of lateral portion 119, and rear wheels 109 reach the descending ramp area of medial portion 120. The descending portions of lateral portion 119 and of medial portion 120 are designed to allow simultaneous lowering of front legs 105 and rear legs 108, thereby providing smooth lowering of inner hull 102.

When inner hull 102 descends to the level where it is resting on outer hull 101 or when front wheels 106 and rear wheels 109 leave their respective portions of platform 118, the inner hull is in its fully lowered position, allowing the vehicle to float in a stable and safe manner. When the vehicle is floating, front wheels 106 and rear wheels 109 do not roll on a surface or bear weight (otherwise, the legs might contact the tow cable pulley).

Figure 2A:
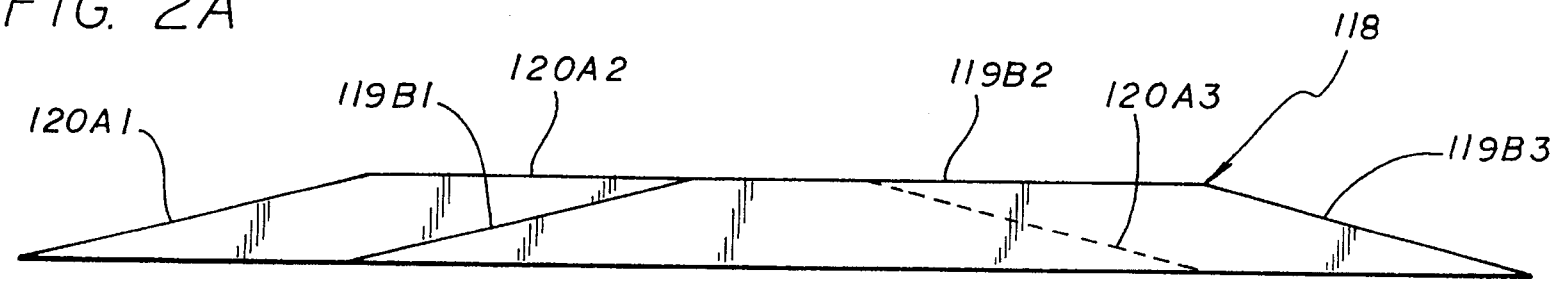
FIG. 2A is an elevation view of ramp 118 of the preferred embodiment of the present invention.

FIG. 2A is an elevation view of platform 118 of the preferred embodiment of the present invention. As described in reference to FIG. 1, a vehicle first begins to pass over medial portion 120 of platform 118. Medial portion 120 of platform 118 includes ascending ramp area 120A1, flat area 120A2, and descending ramp area 120A3. After the vehicle has begun to pass over medial portion 120, it begins to pass over lateral portion 119. Lateral portion 119 includes ascending ramp area 119B1, flat area 119B2, and descending ramp area 119B3. Ascending ramp areas 119A1, 119B1, and 120A1 are of the same length and rise to the same height. Flat areas 119A2, 119B2, and 120A2 are of the same length and height. Descending ramp areas 119A3, 119B3, and 120A3 are of the same length and drop the same distance. However, areas 119A1, 119A2, 119A3, 119B1, 119B2, and 119B3 are offset relative to areas 120A1, 120A2, and 120A3 by a distance equal to the wheelbase of the vehicle so as to maintain inner hull 102 at a level attitude as the inner hull assembly ascends and descends the ramp areas of platform 118.

Figure 2B:
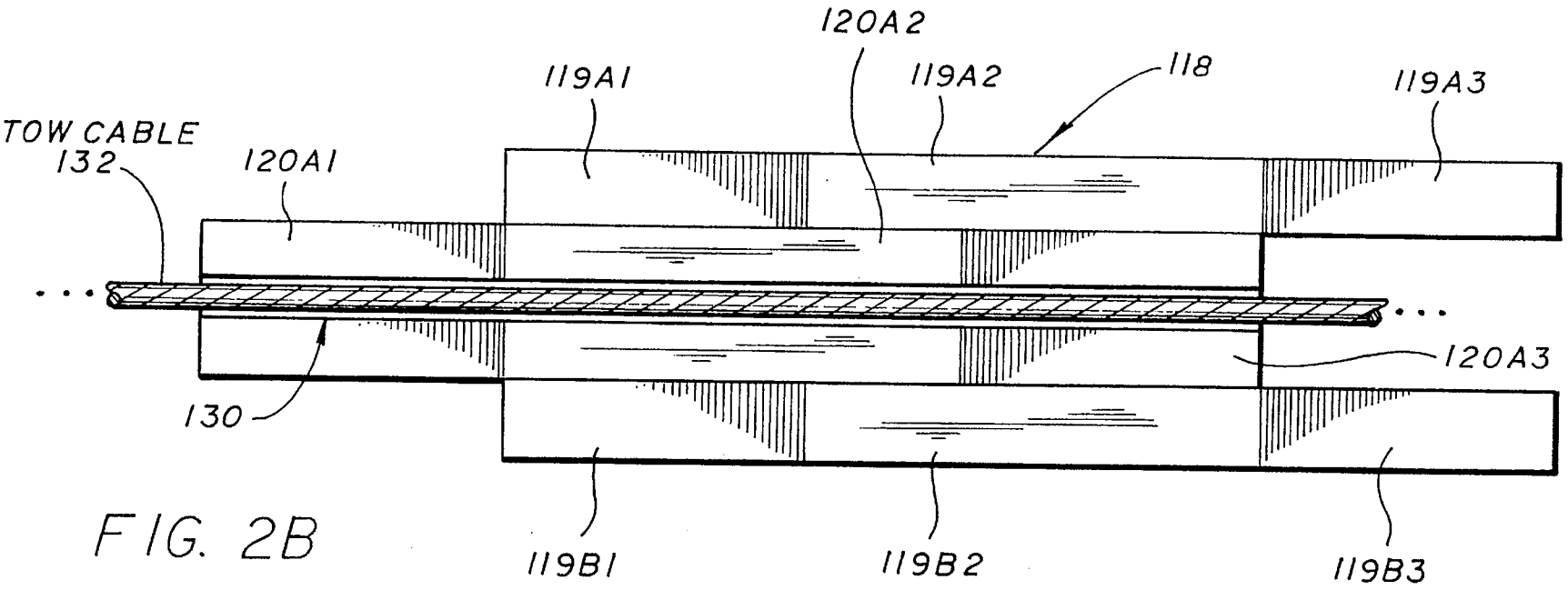
FIG. 2B is a plan view of ramp 118 of the preferred embodiment of the present invention.

FIG. 2B is a plan view of platform 118 of the preferred embodiment of the present invention. Ascending ramp area 120A1 rises to flat area 120A2. Descending ramp area 120A3 descends from flat area 120A2. Ascending ramp area 119A1 rises to flat area 119A2. Descending ramp area 119A3 descends from flat area 119A2. Ascending ramp area 119B2 rises to flat area 119B2. Descending ramp area 119B3 descends from flat area 119B2. Areas 119A1, 119A2, and 119A3 are aligned with areas 119B1, 119B2, and 119B3, but these areas are offset from areas 120A1, 120A2, and 120A3. The amount of offset is dependent on the wheelbase of the vehicle, which may be an arbitrary distance. Platform 118 further comprises a slot 130 that passes centrically through ramp 118. Slot 130 provides a conduit for tow cable 132 through ramp 118.

Figure 3:
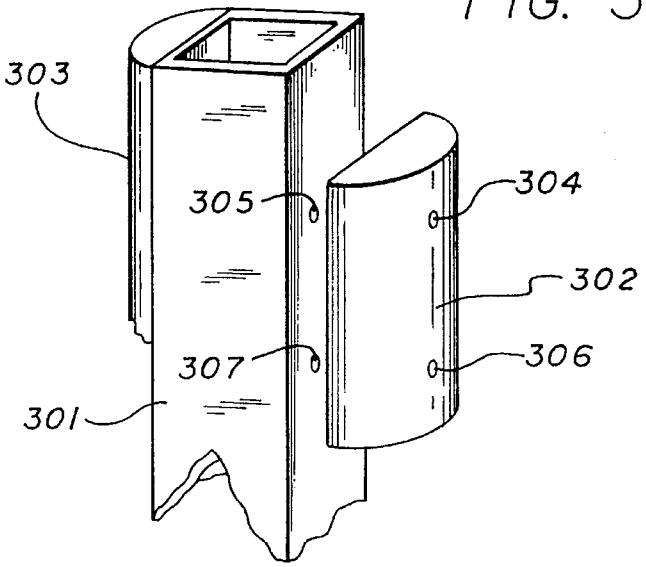
FIG. 3 is a perspective view of a leg assembly such as may be used for the front and/or rear legs of the vehicle of the present invention.

FIG. 3 is a perspective view of a leg assembly such as may be used for the front and/or rear legs of the vehicle of the present invention. The leg assembly comprises leg 301, curved portion 302, and curved portion 303. Leg 301 is preferably a square or rectangular tube made of a metal or alloy, such as steel or stainless steel. Curved portions 302 and 303 may be made of any material suitable for immersion in water, such as a polymer, composite, metal, closed cell foam, etc. Fasteners may be passed through holes 304 and 306 in curved portion 302 into holes 305 and 307 in leg 301 to secure curved portion 302 to leg 301. Curved portion 303 may be secured to leg 301 in a similar manner.

The leg assembly is curved to decrease drag as the vehicle moves through the water. Other methods may be used to decrease drag, such as forming leg 301 of a material or encasing the leg in a material having a cross section that provides lower drag, such as an elliptical cross section.

Figure 4:
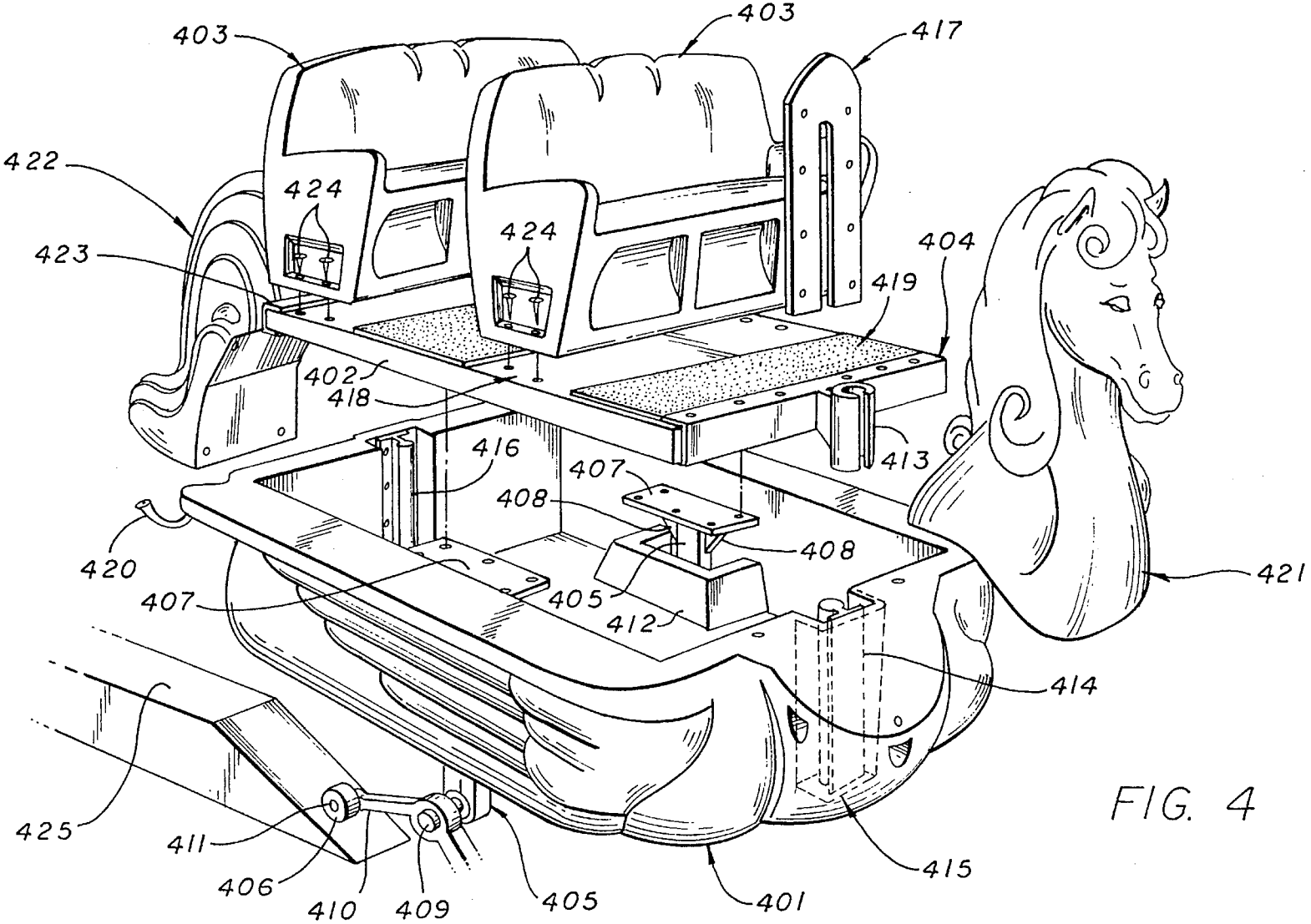
FIG. 4 is an exploded perspective view of a first alternate embodiment of the present invention.

FIG. 4 is an exploded perspective view of a first alternate embodiment of the present invention. This embodiment comprises outer hull 401, inner hull 402, and one or more seats 403. Seats 403 are mounted on inner hull 402 by driving bolts 424 into threaded inserts 418. Textured floor mat 419 is applied to inner hull 402 to provide a non-slip surface. Channels 404 is attached to the front edge of inner hull 402. Linear bearing 413 is attached to channel 404 to ensure low friction linear motion between inner hull 402 and outer hull 401. Linear bearing 413 travels along linear bearing guide 414, which is mounted on outer hull 401. A similar linear bearing is attached to channel 423, which is attached to the rear edge of inner hull 402. The linear bearing on channel 423 travels along linear bearing guide 416, which is attached to outer hull 401. Linear bearing 413 is covered by cover plate 417 to enhance appearance and safety. The linear bearing on channel 423 is also covered by a similar cover plate.

Additional structures may be attached to outer hull 401. For example, head attachment 421 and tail attachment 422 may be added for aesthetic or decorative purposes.

Bilge tube 420 is connected to outer hull 401 to allow removal of accumulated water inside outer hull 401. Outer hull 401 includes leg hole wells 412 to allow legs 405 to pass through outer hull 401.

Mounting plates 407 are attached to the upper ends of legs 405. Gussets 408 may be used to strengthen the joint between mounting plates 407 and legs 405. The lower ends of legs 405 include pivot point 409. Pivot arm 410 pivots about pivot point 409. Pivot arm 410 has an inverted V-shape with each end having an axle 411. Axles 411 allow wheels 406 to rotate with low friction. Wheels 406 roll over ramp 425 as the vehicle passes the dispatch area. Ramp 425 ascends on the approach to the dispatch area and descends on the departure from the dispatch area. As the vehicle approaches the dispatch area, ramp 425 elevates wheels 406, which elevate legs 405, thereby elevating inner hull 402. As the vehicle departs from the dispatch area, ramp 425 lowers wheels 406, which lower legs 405, thereby lowering inner hull 402.

Figure 5A:
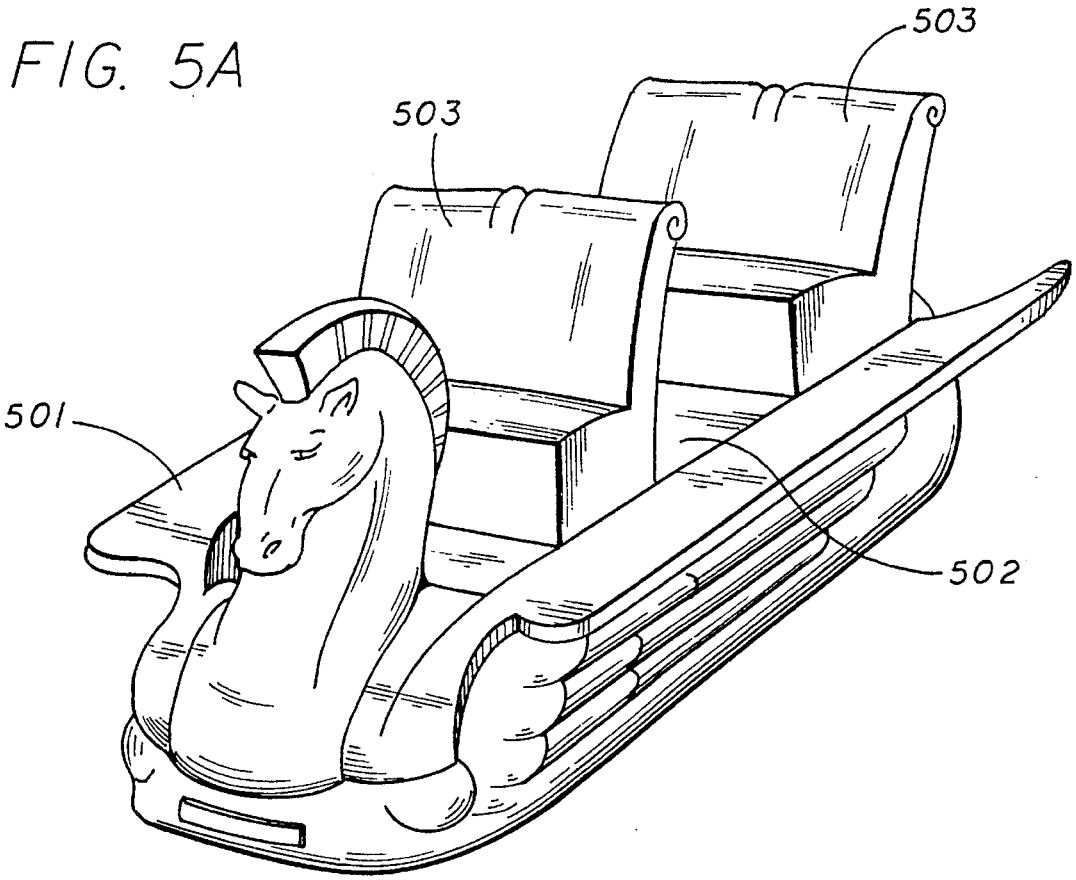
FIG. 5A is a perspective view of a second alternate embodiment of the present invention.

FIG. 5A is a perspective view of a second alternate embodiment of the present invention. Seats 503 are mounted upon inner hull 502, which is located within outer hull 501. Inner hull 502 and seats 503 are illustrated in their elevated position.

Figure 5B:
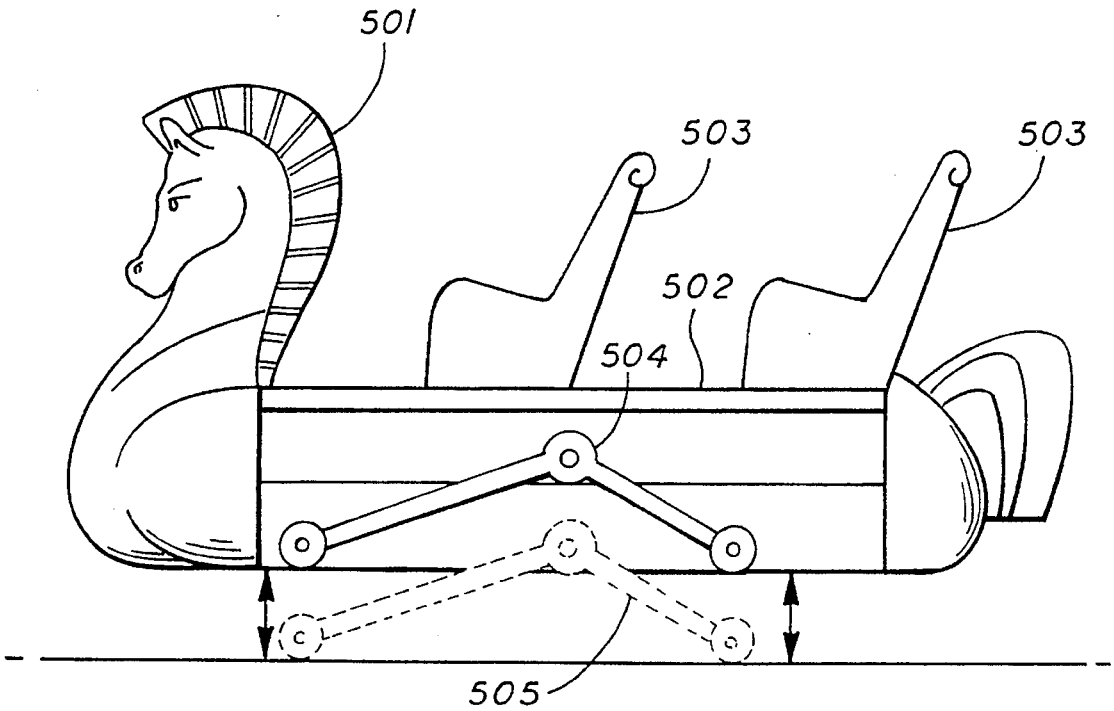
FIG. 5B is a cutaway elevation view of the second alternate embodiment of the present invention.

FIG. 5B is a cutaway elevation view of the second alternate embodiment of the present invention. Seats 503 are mounted on inner hull 502, which is located within outer hull 501. Pivot arm 504, which is attached to inner hull 502, is shown in the elevated position. Pivot arm 505 illustrates the position pivot arm 504 would be in if it, along with inner hull 502 and seats 503 were in the lowered position. The difference in position between pivot arm position 504 and pivot arm position 505 illustrates the movement of the combination of pivot arm 504, inner hull 502, and seats 503 relative to outer hull 501.

FIGS. 6A–6E provide a sequence of elevation views over time as a vehicle built according to the present invention moves from a load/unload mode to a floating mode. During the load/unload mode, inner hull 602 is raised relative to outer hull 601. During the floating mode, inner hull 602 is lowered relative to outer hull 601. During the interim stages between the load/unload mode and the floating mode, inner hull 602 descends relative to outer hull 601.

Figures 6A, 6B, 6C, 6D, 6E, 6F:
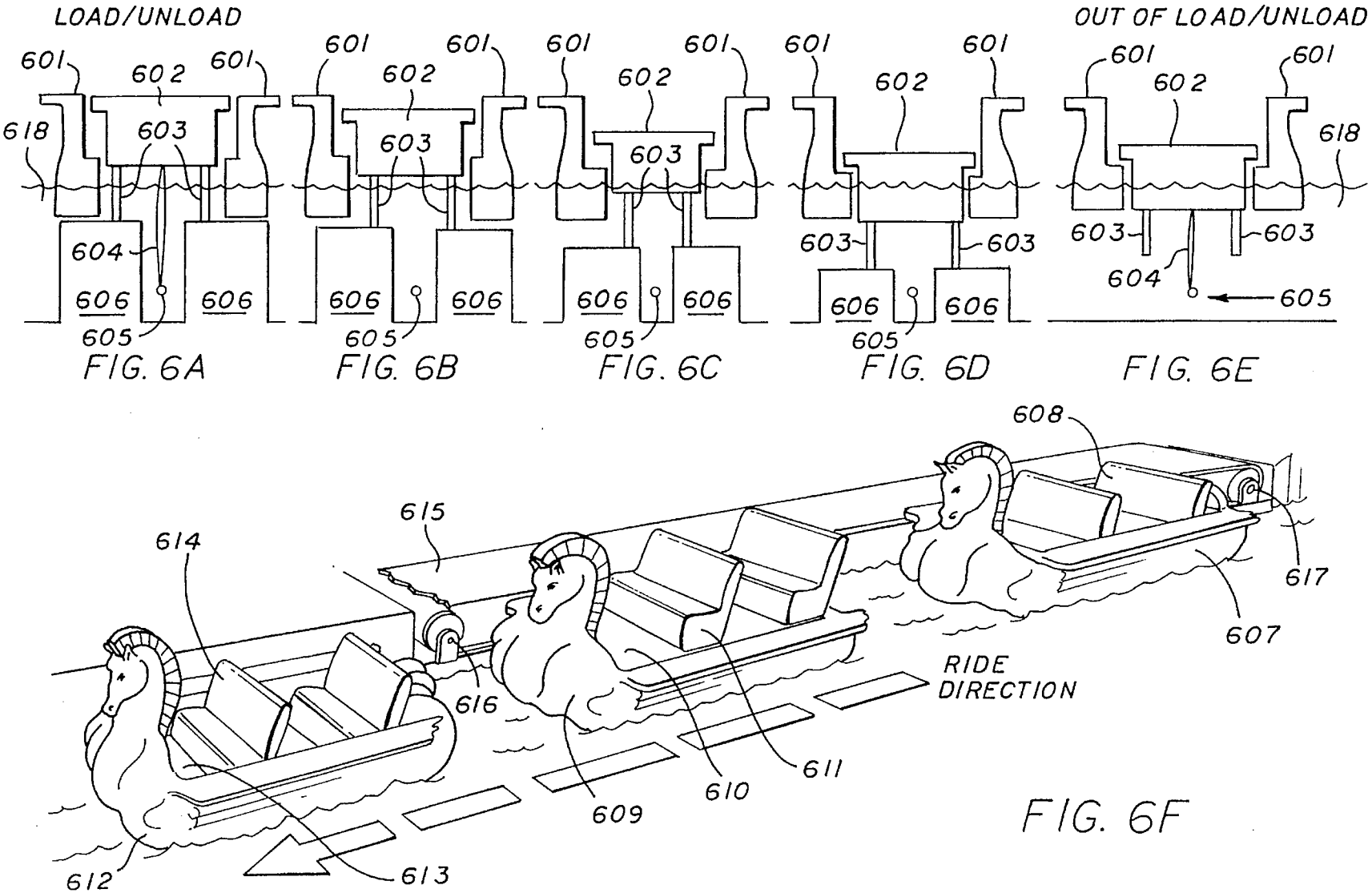
FIG. 6A illustrates a vehicle built according to the present invention in the load/unload mode.
FIG. 6B illustrates a vehicle built according to the present invention shortly after it has begun the transition from the load/unload mode to the floating mode.
FIG. 6C illustrates a vehicle built according to the present invention after it has moved farther along the transition from the load/unload mode to the floating mode.
FIG. 6D illustrates a vehicle built according to the present invention after it has moved toward the end of platform 606.
FIG. 6E illustrates a vehicle built according to the present invention after it has reached the floating mode and is no longer over platform 606.
FIG. 6F illustrates the dispatch area of a ride built according to the present invention.

FIG. 6A illustrates a vehicle built according to the present invention in the load/unload mode. While in the load/unload mode, legs 603 elevate inner hull 602 to a level even with the gunwales of outer hull 601. A dock is provided at the same level to allow passengers to move at the same level from the dock to the gunwales and from the gunwales to inner hull 602. Outer hull 601 is suspended by cables (not shown in FIGS. 6A–6E) from inner hull 602 while in the load/unload mode so that the bottom of outer hull 601 does not contact platform 606. This decreases wear on outer hull 601. The cables maintain the correct elevation between inner hull 602 and outer hull 601 providing stability while passengers enter and exit the vehicle. Tow cable 605 is used to pull the vehicle through water 618. Cable attachment 604 is coupled to inner hull 602 and to tow cable 605.

FIG. 6B illustrates a vehicle built according to the present invention shortly after it has begun the transition from the load/unload mode to the floating mode. Since platform 606 is not as tall as it was in the load/unload mode, legs 603 are allowed to move lower, thus lowering inner hull 602. In FIG. 6B, the water 618 is sufficiently deep so that outer hull 601 floats allowing inner hull 602 to lower within outer hull 601.

FIG. 6C illustrates a vehicle built according to the present invention after it has moved farther along the transition from the load/unload mode to the floating mode. Since platform 606 is lower than it previously was, legs 603 are allowed to move lower, thus lowering inner hull 602.

FIG. 6D illustrates a vehicle built according to the present invention after it has moved toward the end of platform 606. Since platform 606 is even lower than it was before, legs 603 are allowed to move even lower, thus further lowering inner hull 602.

FIG. 6E illustrates a vehicle built according to the present invention after it has reached the floating mode and is no longer over platform 606. Since platform 606 is no longer under legs 603, legs 603 are allowed to fully descend, thus allowing inner hull to fully descend, providing a safe and stable ride.

FIG. 6F illustrates the dispatch area of a ride built according to the present invention. Three vehicles are illustrated. The vehicle having outer hull 607 is approaching the dispatch area, but is still in the floating mode. Seats 608 are in the lowered position. The vehicle having outer hull 609 is in the dispatch area and is in the load/unload mode. Inner hull 610 and seats 611 are in the elevated position. The vehicle having outer hull 612 is departing from the dispatch area. Inner hull 613 and seats 614 are in the lowered position. In an embodiment of the present invention, a moving walkway comprising belt 615 and rollers 616 and 617 and the vehicles move at the variable rates. The variable rates of the moving walkway and vehicles allow entrance and exit from the vehicles without requiring the vehicles to stop. In yet another embodiment of the present invention, two sets of belts are used in the load/unload area.

Figure 7:
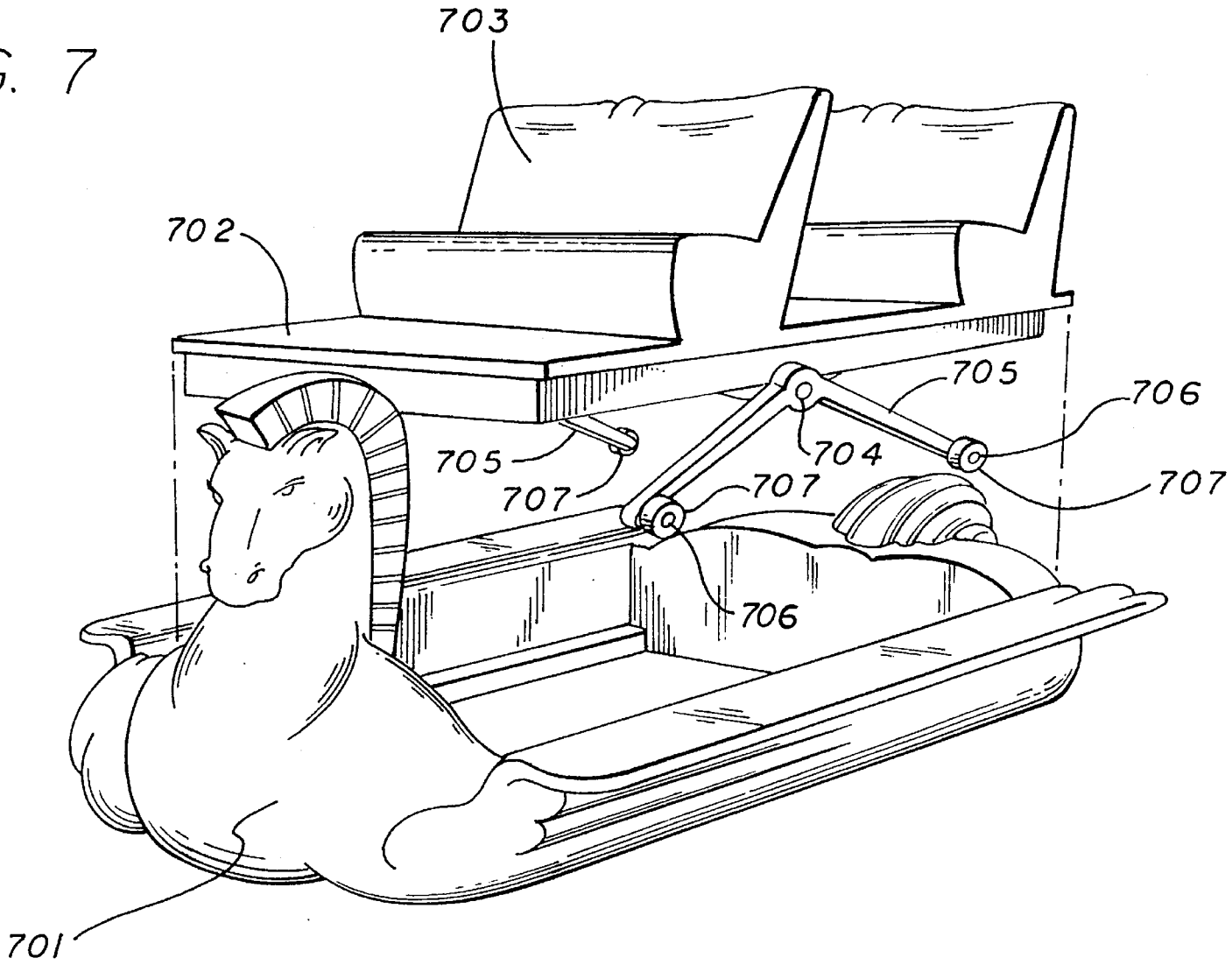
FIG. 7 is an exploded perspective view of another embodiment of the present invention.

FIG. 7 is an exploded perspective view of the second alternate embodiment of the present invention. Seats 703 are mounted on inner hull 702. Pivot points 704 are attached to each side of inner hull 702. Pivot arms 705 are located on each side of inner hull 702 and rotate about pivot points 704. Axles 706 are located at each end of each of pivot arms 705. Wheels 707 rotate about axles 706. Inner hull 702 is placed within outer hull 701, allowing pivot arms 705, axles 706, and wheels 707 to extend below outer hull 701.

Figure 8A:
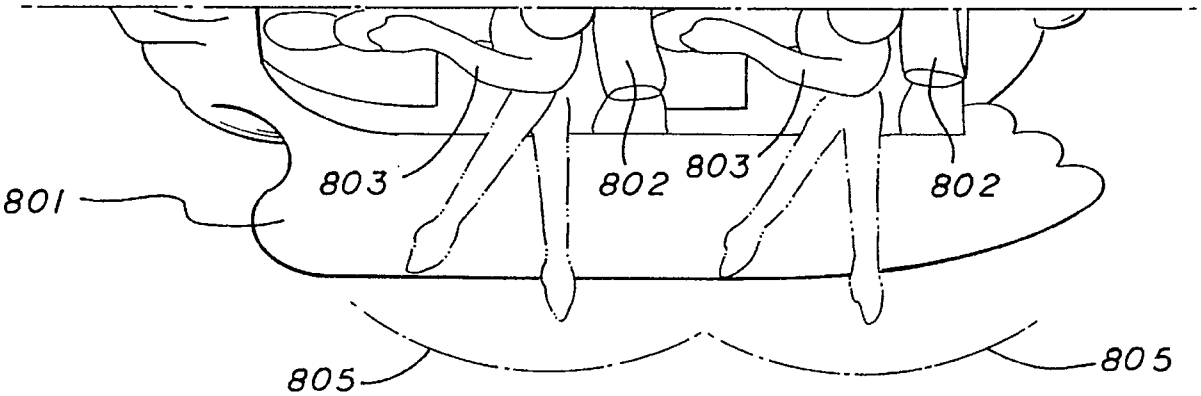
FIG. 8A is a plan view of a portion of the first alternate embodiment of the present invention.

FIG. 8A is a plan view of a portion of the first alternate embodiment of the present invention. Passengers 803 are seated on seats 802, which are located within outer hull 801. The arms of passengers 803 can swing through arc 805. Outer hull 801 is shaped so as to protect the hands of passengers 803 from injury from contact with outer shell 801 or some external structure, such as a dock in the dispatch area.

Figure 8B:
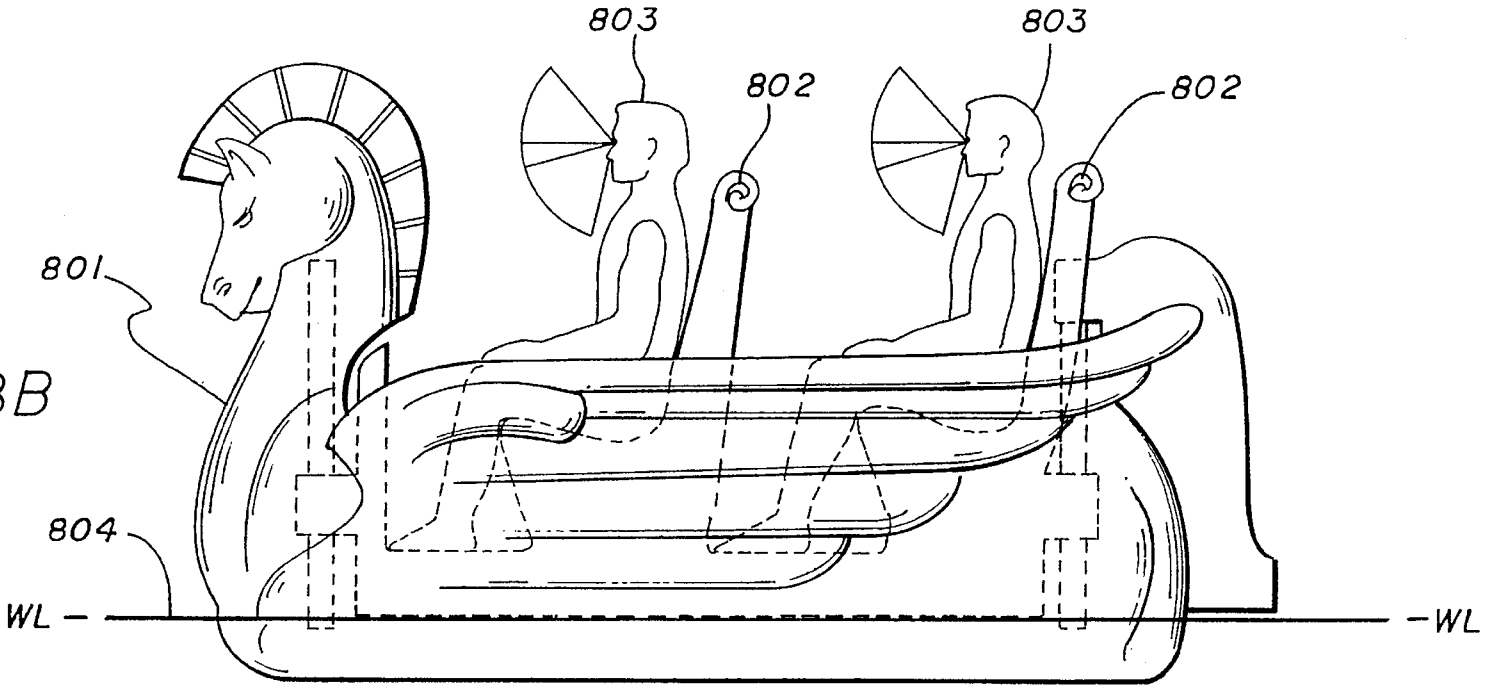
FIG. 8B is an elevation view of the first alternate embodiment of the present invention.

FIG. 8B is an elevation view of the first alternate embodiment of the present invention. The vehicle is shown in the floating mode with seats 802 in the lowered position. Passengers 803 are seated on seats 802, which are located within outer hull 801. Water line 804 indicates the level of the surface of the water on outer hull 801 when outer hull 801 is floating.

Figure 9:
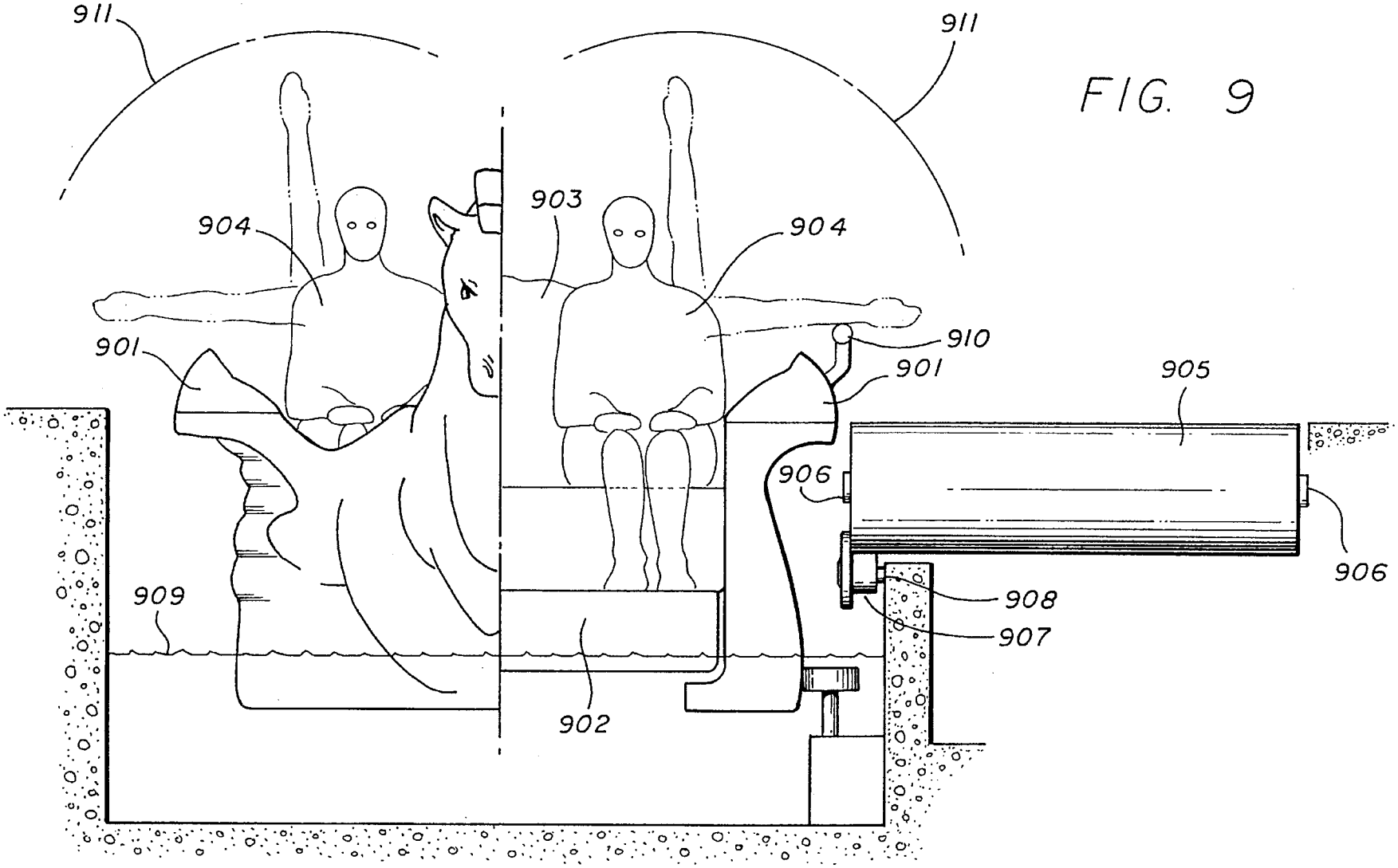
FIG. 9 is a front elevation view of an embodiment of the present invention.

FIG. 9 is a front elevation view of the preferred embodiment of the present invention. The vehicle is shown in the floating mode with inner hull 902 and seats 903 in the lowered position. Passengers 904 are seated on seats 903, which are mounted on inner hull 902. The arms of passengers 904 can sweep through arcs 911. A moving walkway includes belt 905 rotating about a roller centered around axle 906 at one end of the moving walkway. The present invention is not limited to being practiced with rollers of a specific diameter. Although the present invention may be practiced with rollers of a smaller diameter, rollers of a larger diameter are preferred. Support roller 907 rotates about axle 908 and provides support for belt 905. Other belt mounting and support means may alternatively be used. Railing 910 is mounted on outer hull 901 and is provided to keep the hands of passengers 904 away from the moving walkway. Outer hull 901 floats on water 909.

Figure 10:
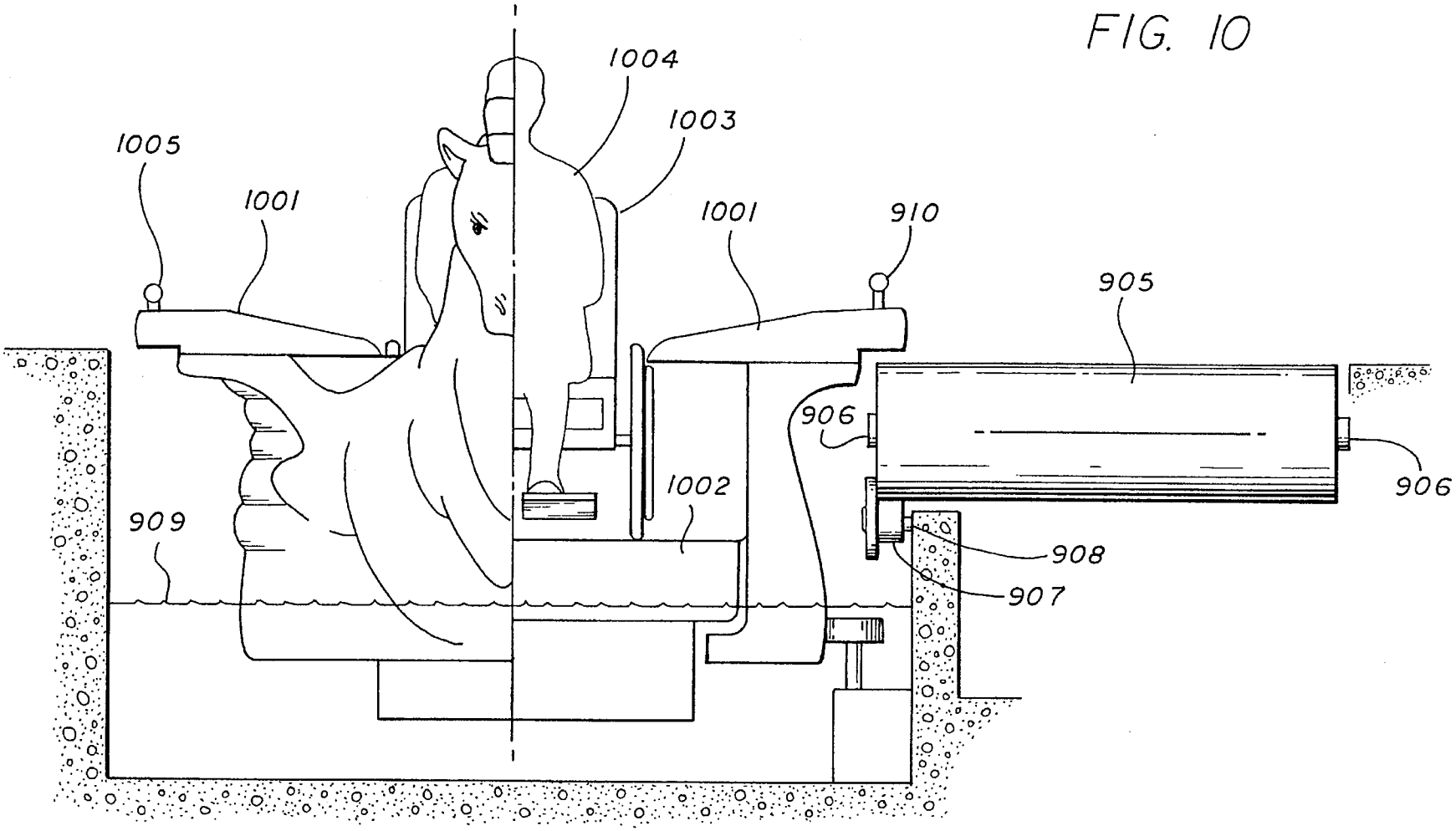
FIG. 10 is a cutaway front elevation view of the second alternate embodiment of the present invention.

FIG. 10 is a cutaway front elevation view of the preferred embodiment of the present invention. A moving walkway includes belt 905, which rides around a roller that rotates about axle 906, and support roller 907, which rotates about axle 908. Railing 910 is mounted on outer hull 1001 and is provided to prevent inadvertent contact between passenger 1004 and the moving walkway. Railing 1005 may optionally be mounted on the opposite side of outer hull 1001. Also, outer hull 1001 is wide enough to overlap the edge of the dock and a portion of belt 905 to provide further protection and stability. This embodiment allows a single passenger 1004 to sit on seat 1003, although there may be a plurality of seats 1003 in tandem. By using a one person seat, the gunwales of outer hull 1001 may be made wider. A one person seat also assures better centering of the load (e.g., the mass of the passengers) over the centerline of outer hull 1001, thereby increasing the vehicle's stability in the floating mode. Seat 1003 and inner hull 1002 are shown in the lowered position. Outer hull 1001 floats on water 909.

Figure 11:
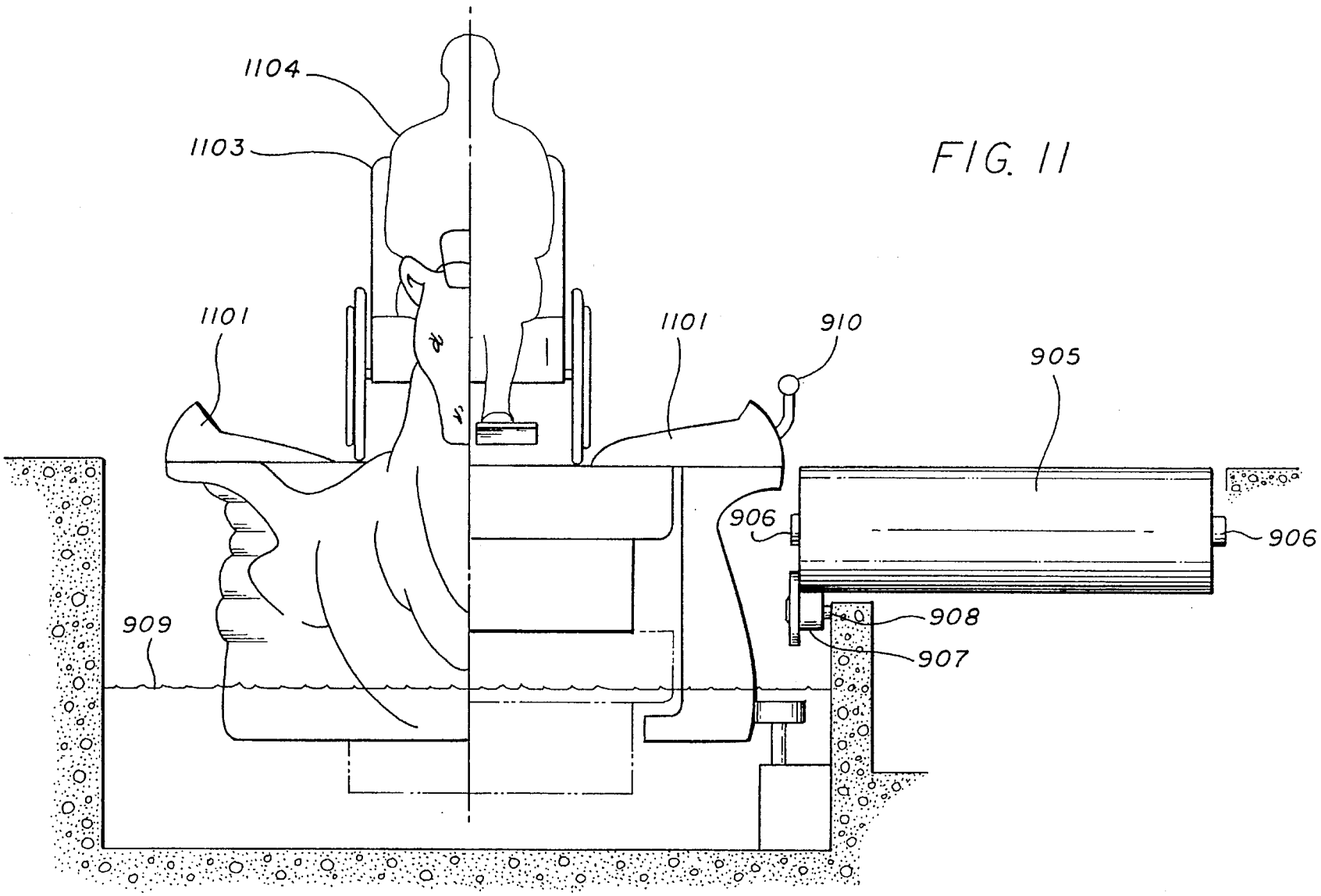
FIG. 11 is a cutaway front elevation view of an embodiment of the present invention.

FIG. 11 is a cutaway front elevation view of the preferred embodiment of the present invention. Passenger 1104 is seated on seat 1103. Seat 1103 is shown in the elevated position, allowing passenger 1104 to board and disembark from the vehicle. Passenger 1104 may step on gunwales 1101 while boarding and disembarking. The gunwales and a moving walkway including belt 905 are designed to move together, allowing passengers to board and disembark from the vehicle while the vehicle is in motion. Belt 905 rotates about axle 906 and is supported by roller 907, which rotates about axle 908. Outer hull 1101 floats on water 909.

Figure 12:
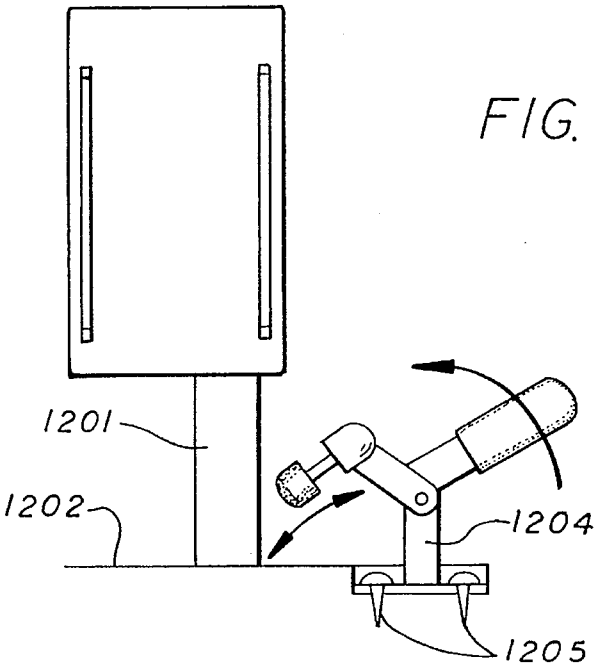
FIG. 12 is an elevation view of apparatus for securing a wheelchair to a vehicle built according to the present invention.

FIG. 12 is an elevation view of apparatus for securing a wheelchair to a vehicle built according to the present invention. Inner hull 1202 supports wheels 1201 of a wheelchair. Clamps 1204 are provided to clamp wheels 1201 onto inner hull 1202. Clamps 1204 are attached to inner hull 1202 with screws 1205.

Figure 13A:
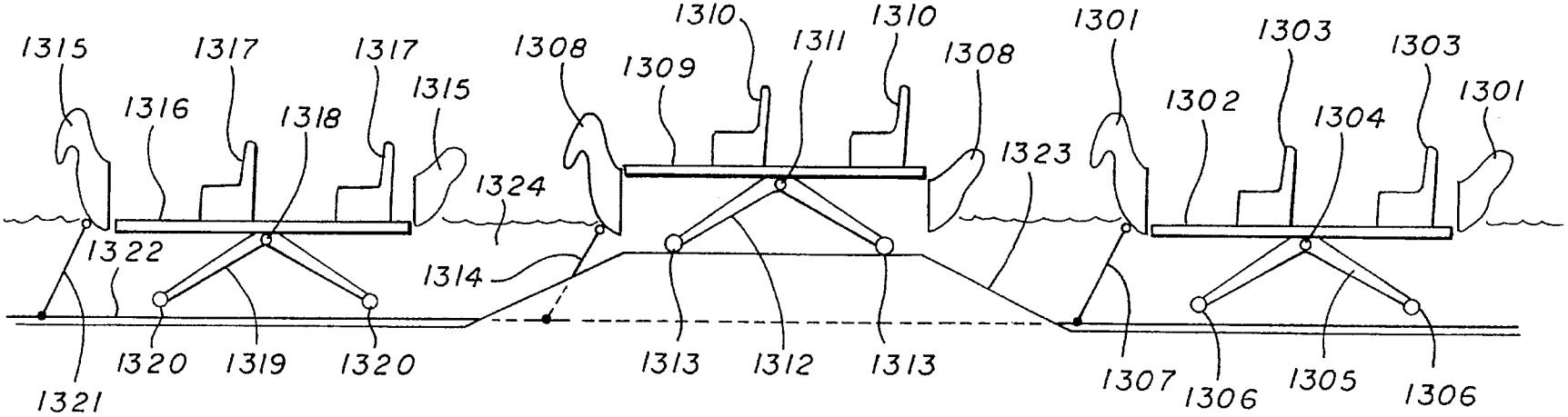
FIG. 13A is a cutaway side elevation view of the second alternate embodiment of the present invention.

FIG. 13A is a cutaway side elevation view of the second alternate embodiment of the present invention. A first ride vehicle comprising outer hull 1301, inner hull 1302, seats 1303, pivot 1304, rocker arm 1305, wheels 1306, and cable attachment 1307 is shown approaching a dispatch area. A second ride vehicle comprising outer hull 1308, inner hull 1309, seats 1310, pivot 1311, rocker arm 1312, wheels 1313, and cable attachment 1314 is shown at the dispatch area. A third ride vehicle comprising outer hull 1315, inner hull 1316, seats 1317, pivot 1318, rocker arm 1319, wheels 1320, and cable attachment 1321 is shown departing from the dispatch area. The first ride vehicle is in a floating mode with its inner hull 1302 and seats 1303 in a lowered position. The second ride vehicle is in a load/unload mode with its inner hull 1309 and seats 1310 in a raised position. The third ride vehicle is in a floating mode with its inner hull 1316 and seats 1317 in a lowered position.

Cable attachment 1307 attaches the first ride vehicle to cable 1322. Cable attachment 1314 attaches the second ride vehicle to cable 1322. Cable attachment 1321 attaches the third ride vehicle to cable 1322. Platform 1323 is located at the dispatch area to elevate the inner hull assemblies of the ride vehicles as they pass the dispatch area. Platform 1323 has a cable trough in which cable 1322 lies to allow cable 1322 to pass through platform 1323. Platform 1323, cable 1322, and cable attachments 1307, 1314, and 1321 are all submersed in water 1324.

Cable 1322 is caused to move through water 1324, pulling cable attachments 1307, 1314, and 1321 and their respective vehicles through water 1324. As a ride vehicle approaches platform 1323, the wheels and rocker arms associated with that vehicle are lifted by the rising portion of platform 1323, causing the inner hull and seats of the vehicle to be lifted. As a ride vehicle departs from platform 1323, the wheels and rocker arms associated with that vehicle are lowered by the descending portion of platform 1323, causing the inner hull and seats of the vehicle to be lowered.

Figure 13B:
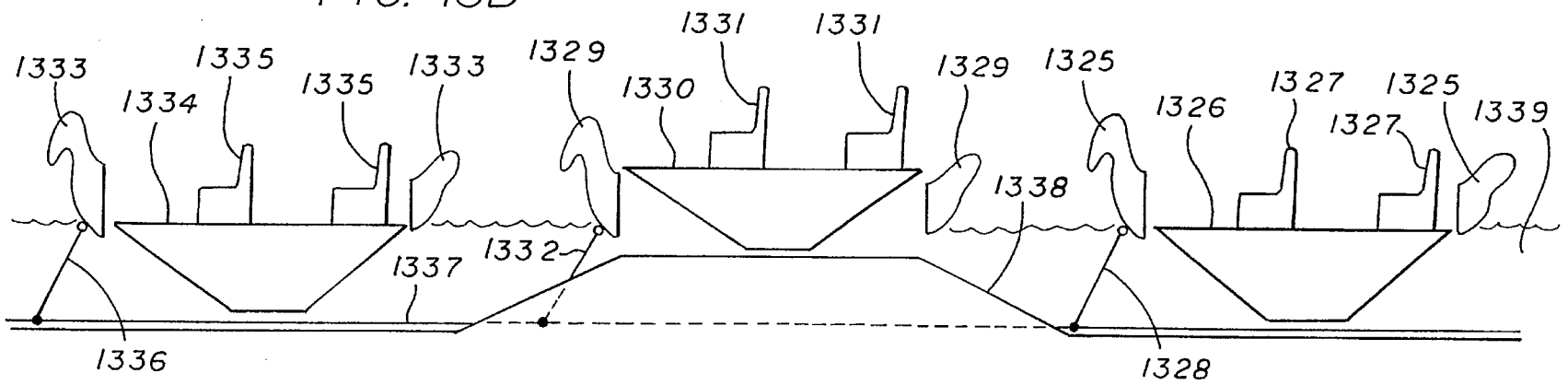
FIG. 13B is a cutaway side elevation view of a third alternate embodiment of the present invention.

FIG. 13B is a cutaway side elevation view of a third alternate embodiment of the present invention. A first ride vehicle comprising outer hull 1325, inner hull 1326, seats 1327, and cable attachment 1328 is approaching a dispatch area. A second ride vehicle comprising outer hull 1329, inner hull 1330, seats 1331, and cable attachment 1332 is passing the dispatch area. A third ride vehicle comprising outer hull 1333, inner hull 1334, seats 1335, and cable attachment 1336 is departing from the dispatch area. Cable attachments 1328, 1332, and 1336 are attached to cable 1337, which pulls the first, second, and third ride vehicles through water 1339.

As a ride vehicle approaches platform 1338, the sloped surface of the inner hull of the ride vehicle contacts the rising surface of platform 1338. A low friction interface, or rollers, or belts is provided between the inner hull and the platform. The inner hull and/or the platform may be constructed of or covered with a material having low friction properties, such as polytetrafluoroethylene, polyethylene, polypropylene, or some other suitable material. As the ride vehicle is pulled onto platform 1338, the sloped surface of the inner hull slides against the rising surface of platform 1338, lifting the inner hull and seats of the vehicle. As the ride vehicle departs from platform 1338, another sloping surface of the inner hull slides against the descending portion of platform 1338, lowering the inner hull and seats of the vehicle.

Figure 14:
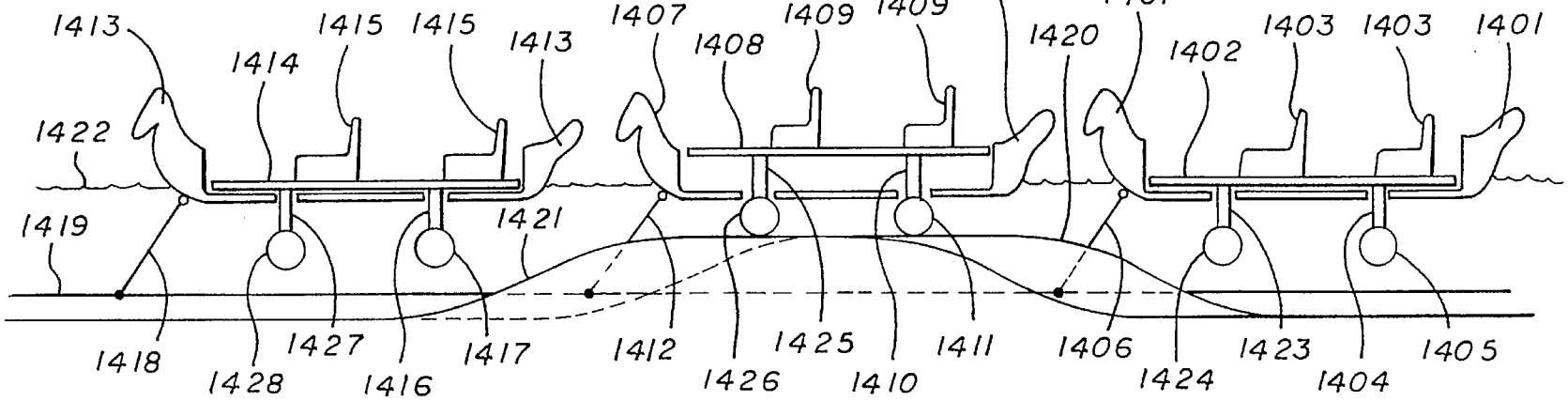
FIG. 14 is a cutaway side elevation view of the preferred embodiment of the present invention.

FIG. 14 is a cutaway side elevation view of the preferred embodiment of the present invention. Three ride vehicles are shown, although it is understood that cable 1419 may be of any practical length and may pull many ride vehicles through water 1422. Cable 1419 preferably forms a continuous loop, pulling ride vehicles from the dispatch area, around the loop, and back to the dispatch area. Platforms 1420 and 1421 are located under water 1422 at the dispatch area. Platforms 1420 and 1421 have cable troughs to accommodate cable 1419.

A first ride vehicle is shown approaching platforms 1420 and 1421. The first vehicle comprises outer hull 1401, inner hull 1402, seats 1403, front legs 1423, rear legs 1404, front wheels 1424, rear wheels 1405, and cable attachment 1406. Front legs 1423, rear legs 1404, front wheels 1424, and rear wheels 1405 hang below outer hull 1401, allowing inner hull 1402 and seats 1403 to rest in a lowered position. Thus, passengers of the first vehicle are safely seated in a stable vehicle.

A second ride vehicle is shown on platforms 1420 and 1421. The second vehicle comprises outer hull 1407, inner hull 1408, seats 1409, front legs 1425, rear legs 1410, front wheels 1426, rear wheels 1411, and cable attachment 1412. The second vehicle is shown with the inner hull and seats in the elevated position. Front wheels 1426 are in contact with platform 1421. Rear wheels 1410 are in contact with platform 1420. Front wheels 1426 and rear wheels 1410 are staggered with respect to one another. Platform 1421 is similarly staggered with respect to platform 1420. For example, front wheels 1426 may be spaced wider than rear wheels 1410 and platform 1421 may be spaced wider than platform 1420. Thus, front lateral wheels 1426 make contact with lateral platform 1421, while rear medial wheels 1411 make contact with medial platform 1420. Staggering the wheels and platforms allows the lifting and lowering of the front wheels and legs to be coordinated with the lifting and lowering of the rear wheels and legs so as to keep the inner hull and seats level during the lifting and lowering process. Since front wheels 1426 and rear wheels 1411 rest on platforms 1421 and 1420 and inner hull 1408 and seats 1409 are in the elevated position, passengers may easily enter and exit the vehicle without climbing up or down and without the vehicle swaying or rolling.

A third ride vehicle is shown departing from platforms 1420 and 1421. The third vehicle comprises outer hull 1413, inner hull 1414, seats 1415, legs 1416, wheels 1417, and cable attachment 1418. Front legs 1427, front wheels 1428, rear legs 1416, and rear wheels 1417 are hanging in water 1422, allowing inner hull 1414 and seats 1415 to rest in a lowered position. Passengers in the third vehicle are safely seated in the vehicle while the vehicle is in a low stable position.

Although the present invention is described with respect to water vehicles, it is understood that the present invention may also be practiced with other types of vehicles. For example, the present invention may be practiced with a roller coaster or other type of vehicle which a passenger must climb up or down to enter or exit. An inner portion of a vehicle may be raised or lowered relative to an outer portion of the vehicle to allow passengers to enter or exit the vehicle without climbing up or down. For a vehicle that rides on one or more rails, another rail or rails may be introduced to raise or lower a portion of the vehicle.

Figure 15A:
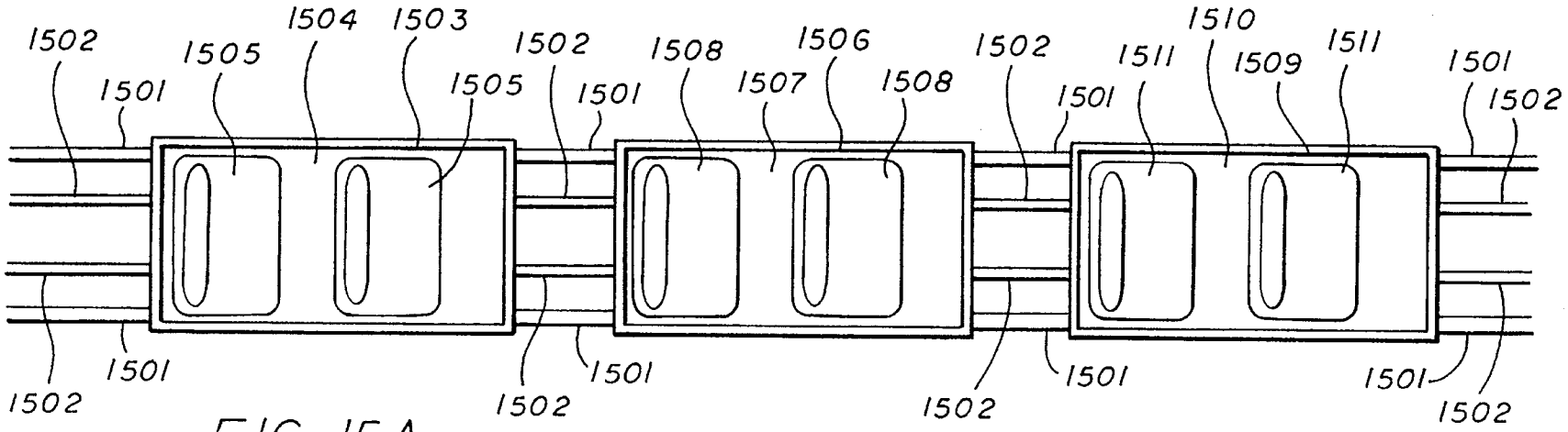
FIG. 15A illustrates a plan view of another embodiment of the present invention.

FIG. 15A illustrates a plan view of another embodiment of the present invention. Three vehicles are illustrated riding on two sets of rails. Outer set of rails 1501 supports outer portions 1503, 1506, and 1509 of first, second, and third vehicles, respectively. Inner set of rails 1502 supports inner portions 1504, 1507, and 1510 of first, second, and third vehicles, respectively. Seats 1505, 1508, and 1511 are mounted on inner portions 1504, 1507, and 1510, respectively. Outer rails 1501 and inner rails 1502 are preferably endless, i.e., they form a continuous loop. Inner rails 1502 lie in the same plane as outer rails 1501 for some portion of the distance around the loop, but diverge out of the plane for some other portion of the distance around the loop, then converge back into the plane. For example, Inner rails 1502 may be raised relative to outer rails 1501 at a dispatch area to facilitate easy loading and unloading of passengers. Alternatively, inner rails 1502 may be lowered relative to outer rails 1501.

Figure 15B:
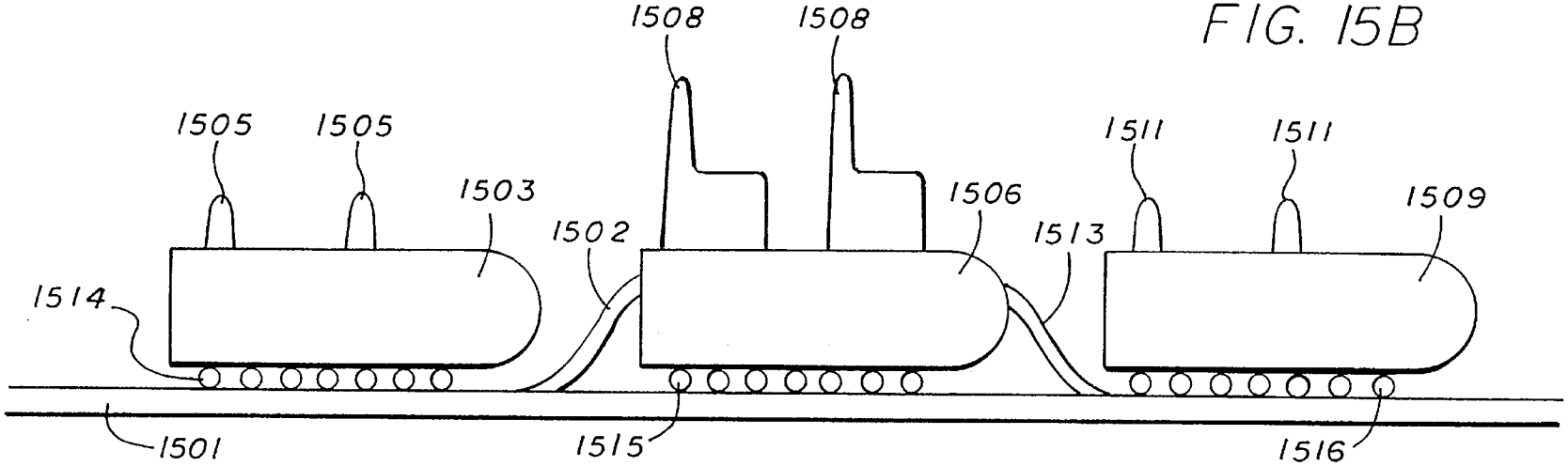
FIG. 15B is a side elevation view of another embodiment of the present invention.

FIG. 15B is a side elevation view of an embodiment of the present invention. Three vehicles are shown, although the present invention may be practiced with as few or as many vehicles as practical and desirable. A first vehicle comprises outer portion 1503, seats 1505, and wheels 1514. A second vehicle comprises outer portion 1506, seats 1508, and wheels 1515. A third vehicle comprises outer portion 1509, seats 1511, and wheels 1516. Wheels 1514 are coupled to outer portion 1503 and to track 1501. Wheels 1515 are coupled to outer portion 1506 and to track 1501. Wheels 1516 are coupled to outer portion 1509 and to track 1501. Other wheels or coupling means are used to couple seats 1505, 1508, and 1511 and their respective inner portions to track 1502. Thus, outer portions 1503, 1506, and 1509 follow track 1501, while seats 1505, 1508, and 1511 and their respective inner portions follow track 1502.

Track 1502 is preferably raised relative to track 1501 for some portion of the distance around the loop of track. Track 1501 may maintain a level height with track 1502 raised above track 1501, or track 1502 may maintain a level height with track 1501 lowered below track 1502.

The first vehicle is shown approaching the dispatch area. The first vehicle is at a point along the tracks where track 1501 and track 1502 lie in the same plane. The second vehicle is shown at the dispatch area. The second vehicle is at a point along the tracks where track 1502 rises above track 1501. By rising above track 1501, track 1502 lifts seats 1508 so that passengers will not have to climb up to get out of the vehicle or climb down to get into the vehicle. The third vehicle is shown departing from the dispatch area. The third vehicle is at a point along the tracks where track 1501 and track 1502 lie in the same plane. It should be noted that dispatch area is not necessarily limited to a single vehicle, but may be long enough to allow exchanging passengers of a plurality of vehicles at the same time.

Figure 16:
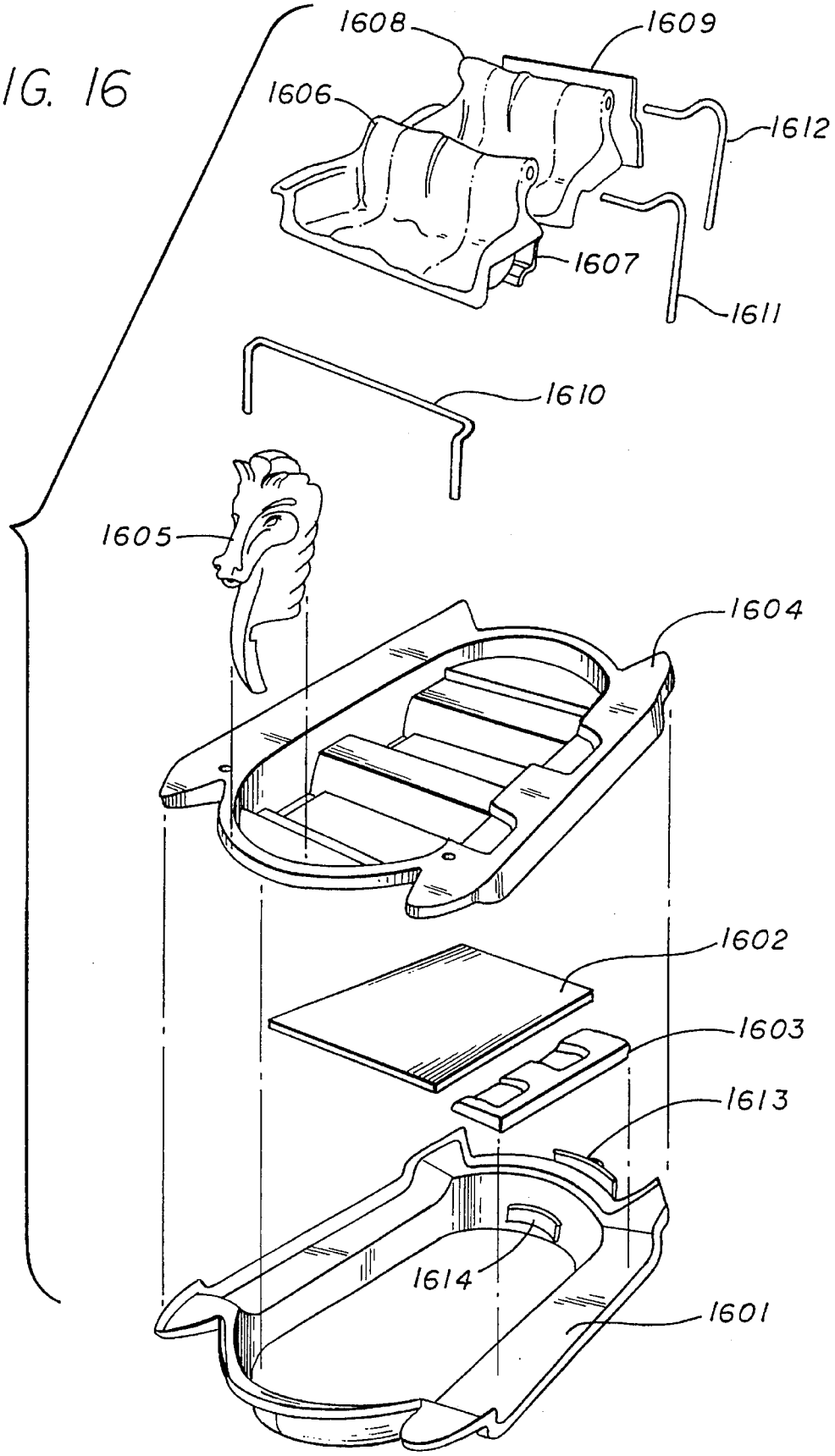
FIG. 16 is an exploded diagram illustrating an alternate embodiment of the present invention.

FIG. 16 is an exploded diagram illustrating an alternate embodiment of the present invention. The embodiment of FIG. 16 is suitable for use by ambulatory passengers. Subfloor 1602 and gunwale reinforcement 1603 lie on the upper surface of lower hull portion 1601. Upper hull portion 1604 lies over subfloor 1602 and gunwale reinforcement 1603. Outer tow anchor plate 1613 is attached to the outer surface of the stern of lower hull portion 1601. Inner tow anchor plate 1614 is attached to the inner surface of the stern of lower hull portion 1601. Bow attachment 1605 is coupled to the bow of lower hull portion 1601. Front seat 1606 is coupled to upper hull portion 1604. Back cover 1607 is coupled to the back of front seat 1606. Rear seat 1608 is coupled to upper hull portion 1604. Back cover 1609 is coupled to the back of rear seat 1608. Handrail 1610 is coupled to upper hull portion 1604. Handrail 1611 is coupled to front seat 1606 and to upper hull portion 1604. Handrail 1612 is coupled to rear seat 1608 and to upper hull portion 1604.

Figure 17:
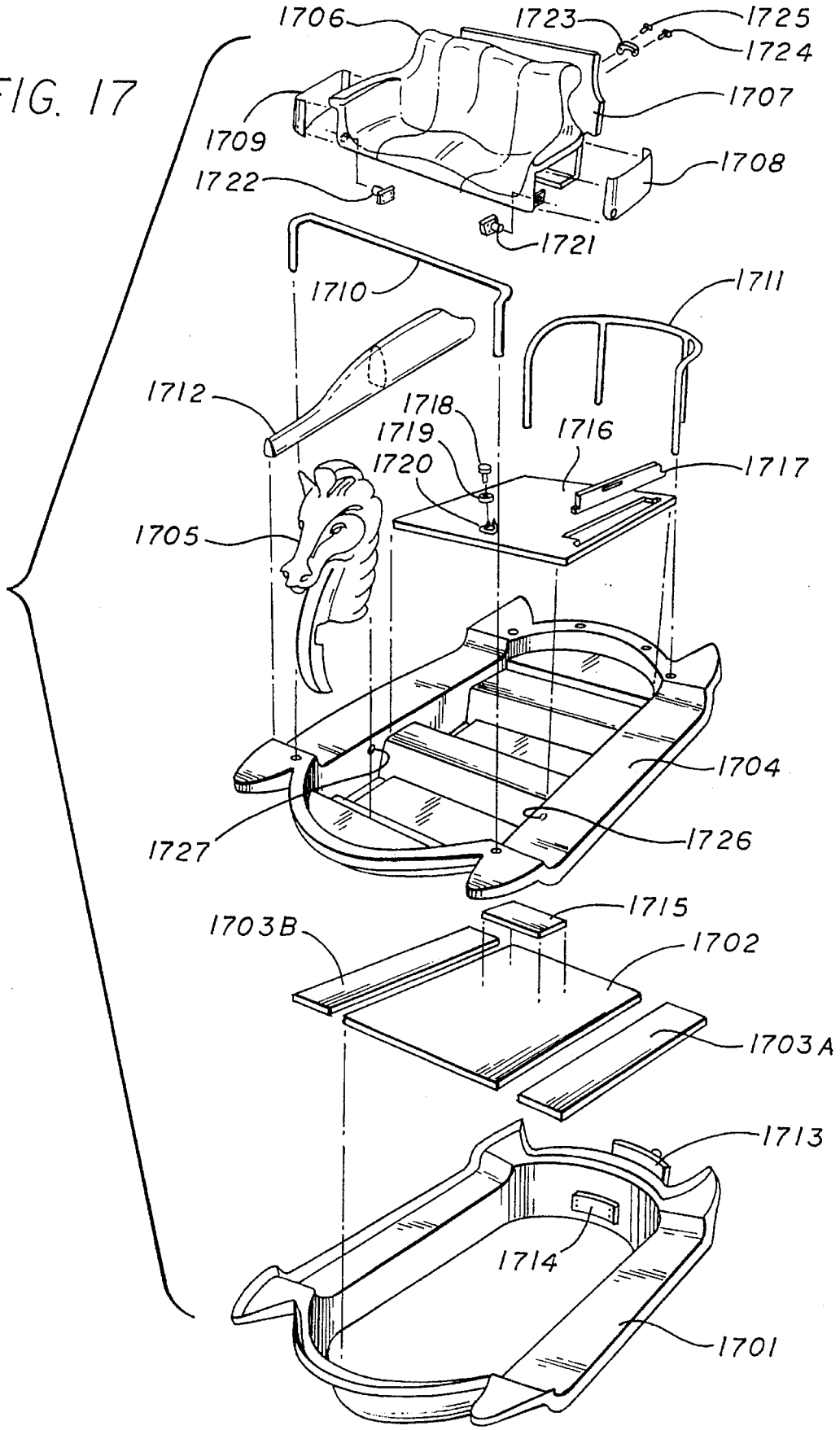
FIG. 17 is an exploded diagram illustrating an alternate embodiment of the present invention.

FIG. 17 is an exploded diagram illustrating an alternate embodiment of the present invention. The embodiment of FIG. 17 is suitable for use by both ambulatory passengers and passengers in wheelchairs. Subfloor 1702 and gunwale reinforcements 1703A and 1703B lie over lower hull portion 1701. Subfloor reinforcement 1715 lies over subfloor 1702. Upper hull portion 1704 lies over lower hull portion 1701, subfloor 1702, subfloor reinforcement 1715, and gunwale reinforcements 1703A and 1703B.

Wheelchair deck 1716 lies over upper hull portion 1704. Guard rail 1717 lies in a recessed area of wheelchair deck 1716. Guard rail 1717 may be flipped down to allow ingress and egress of passengers in wheelchairs and may be flipped up to stop a wheelchair from rolling off wheelchair deck 1716. Bolt 1718 and washer 1719 secure lower catch member 1720 to wheelchair deck 1716.

Bow attachment 1705 is coupled to the bow of upper deck portion 1704. Handrail 1710 is coupled to the bow of upper deck portion 1704. Handrail 1711 is coupled to the stern of upper deck portion 1704. Gunwale attachment 1712 is coupled to the gunwale of upper deck portion 1704 opposite guard rail 1717.

Seat 1706 is coupled to pivot posts 1721 and 1722. Pivot posts 1721 and 1722 engage pivot receptacles 1726 and 1727, respectively, in upper hull portion 1704. Side panels 1708 and 1709 are coupled to the sides of seat 1706. Back panel 1707 is coupled to the back of seat 1706. Bolts 1723 and 1724 secure upper catch member 1723 to back panel 1707. Upper catch member 1723 separably engages lower catch member 1720 to prevent the seat assembly comprising seat 1706, side panels 1708 and 1709, back panel 1707, pivot posts 1721 and 1722, bolts 1724 and 1725, and upper catch member 1723 from unintentionally pivoting. However, when upper catch member 1723 and lower catch member 1720 are disengaged, the seat assembly may be pivoted forward until back panel 1707 lies in substantially the same plane as wheelchair deck 1716, thereby allowing back panel 1707 to serve as a secondary wheelchair deck. When back panel 1707 is used as a secondary wheelchair deck, more than one wheelchair may be carried on a single boat. If necessary, additional reinforcement means may be provided to support back panel 1707. This reinforcement means may have the form of a reinforcement member placed between back panel 1707 and seat 1706.

Figure 18:
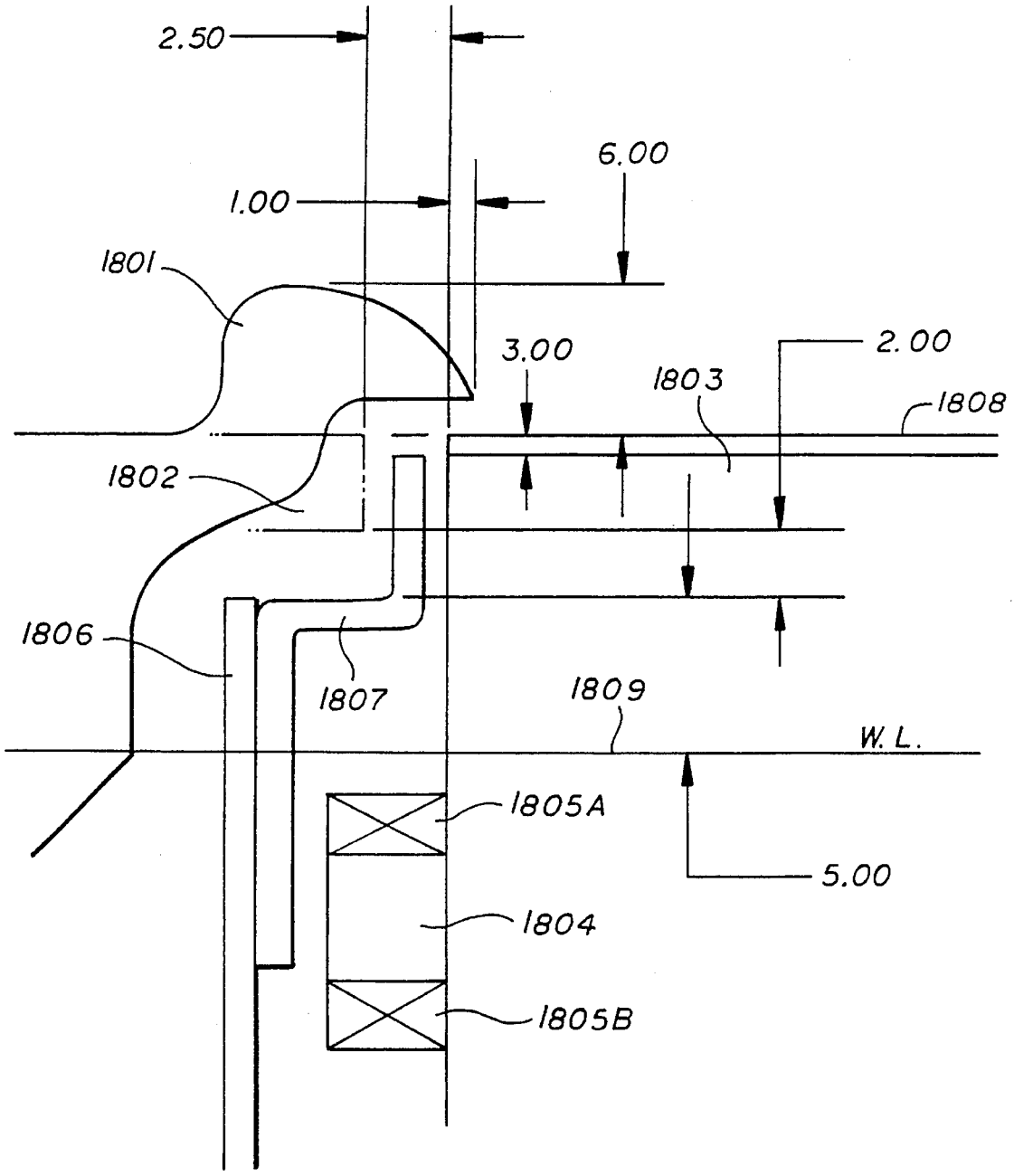
FIG. 18 is a cross sectional diagram illustrating two embodiments of the gunwale and their interaction with an embodiment of the dock.

FIG. 18 is a cross sectional diagram illustrating two embodiments of the gunwale and their interaction with an embodiment of the dock. Gunwale 1801 is a gunwale for boats carrying ambulatory passengers. The bottom edge of gunwale 1801 is positioned approximately three inches higher than dock surface 1808 when the boat is docked. The lateral edge of gunwale 1801 is positioned so as to overhang the edge of dock surface 1808 by approximately one inch. The uppermost point of gunwale 1801 is positioned approximately six inches above dock surface 1808 when the boat is docked.

Gunwale 1802, which is illustrated with interrupted lines, is a gunwale for boats carrying passengers in wheelchairs. The bottom surface of gunwale 1802 is positioned approximately two inches above the upper edge of plate 1806. The upper edge of plate 1806 is positioned approximately five inches above water line 1809. The top surface of gunwale 1802 is positioned in approximately the same plane as dock surface 1808. The lateral surface of gunwale 1802 is positioned approximately two and a half inches away from the edge of dock surface 1808. The nearly continuous horizontal surfaces from dock surface 1808 to the upper surface of gunwale 1802 allow easy boarding and disembarking of passengers in wheelchairs.

Dock surface 1808 is a belt that travels around roller 1803. Roller 1803 rotates about axle 1804. Axle 1804 is mounted on bearings 1805A and 1805B. Rail 1807 covers and prevents unintentional contact with the side of roller 1803, bearing 1805A, and most of axle 1804. Plate 1806 is adjacent to rail 1807 and provides further protection against accidental contact with moving parts. Furthermore, plate 1806 prevents water below water line 1809 from coming in contact with roller 1803, axle 1804, bearings 1805A and 1805B, and dock surface 1808. The center of axle 1804 is located approximately five inches below water line 1809.

Figure 19:
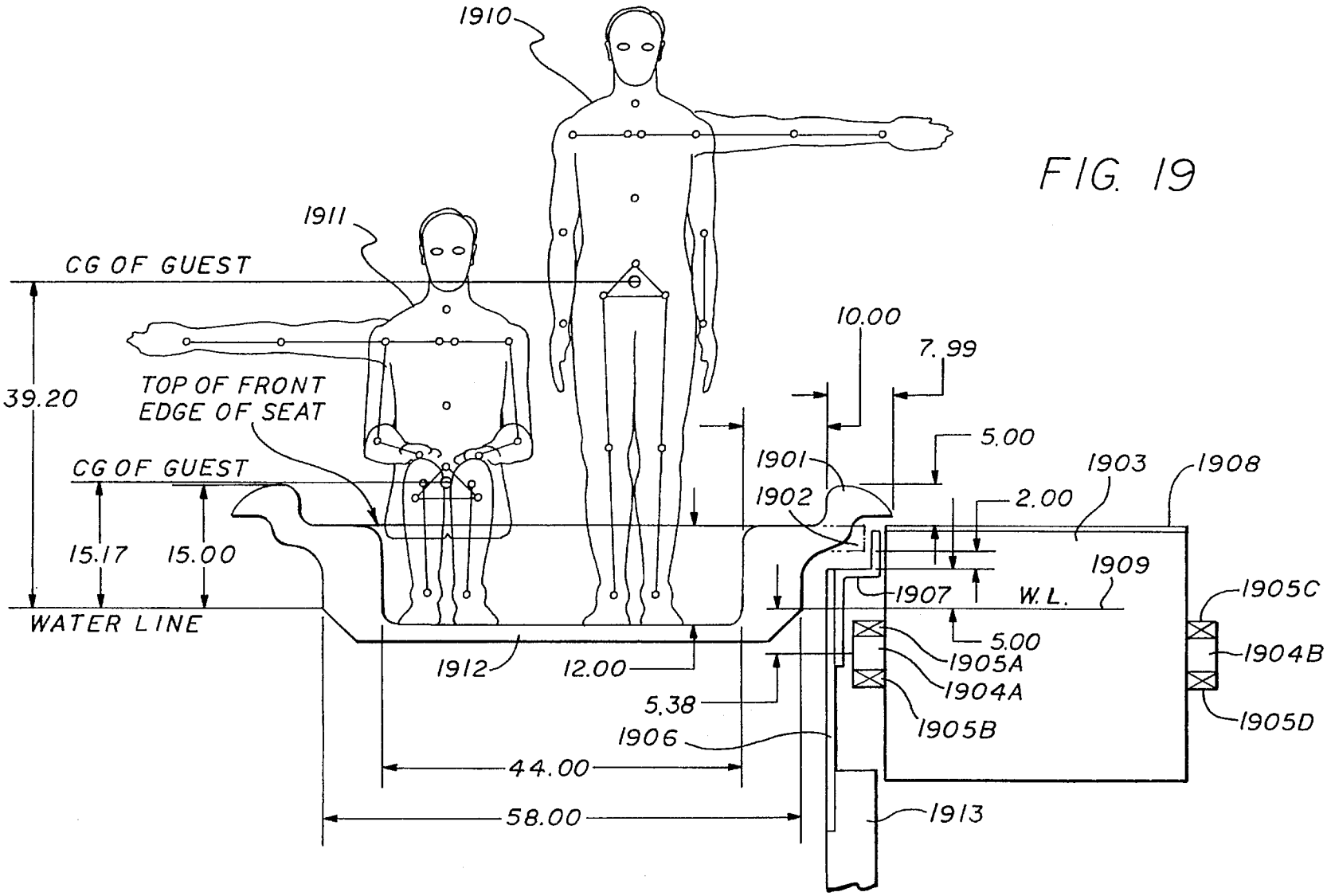
FIG. 19 is a cross sectional diagram illustrating an embodiment of the present invention.

FIG. 19 is a cross sectional diagram illustrating an embodiment of the present invention. Gunwale 1901 is an example of a gunwale for ambulatory passengers, while gunwale 1902 is an example of a gunwale for passengers in wheelchairs. Gunwale 1901 and 1902 are alternative gunwale for boat 1912. The elevated portion of gunwale 1901 is approximately eight inches wide. The uppermost point of gunwale 1901 is approximately five inches above dock surface 1908. Dock surface 1908 is a belt that travels around roller 1903, which has a cylindrical shape. Roller 1903 rotates about an axle having axle ends 1904A and 1904B. Axle end 1904A is mounted on bearings 1905A and 1905B. Axle end 1904B is mounted on bearings 1905C and 1905D. Rail 1907 is positioned along the sides of roller 1903 and dock surface 1908. Plate 1906 is mounted adjacent to rail 1907. Plate 1906 is also located within a recessed portion of wall 1913. Plate 1906 and wall 1913 prevent water below water line 1909 from coming in contact with bearings 1905A, 1905B, 1905C, and 1905D, axle ends 1904A and 1904B, roller 1903, or dock surface 1908.

The lower surface of gunwale 1902 is positioned approximately two inches above the upper horizontal surface of rail 1907, which is located approximately five inches above water line 1909. The center of axle end 1904A is located approximately 5.38 inches below water line 1909.

Passenger 1910 is standing in boat 1912, while passenger 1911 is sitting in boat 1912. The lower and more medial portion of gunwale 1901, which forms a step, is approximately 10 inches wide. An area 12 inches deep extends below the level of the lower and more medial portions of the gunwale into the hull of boat 1912. This area is approximately 44 inches wide and allows room for passengers in boat 1912. The width of this area including the thicknesses of the sides of the boat is approximately 58 inches. Use of these dimensions places the center of gravity of standing passenger 1910 approximately 39.2 inches above water line 1909 and the center of gravity of sitting passenger 1911 approximately 15 inches above water line 1909.

Figures 20, 20A, 20B:
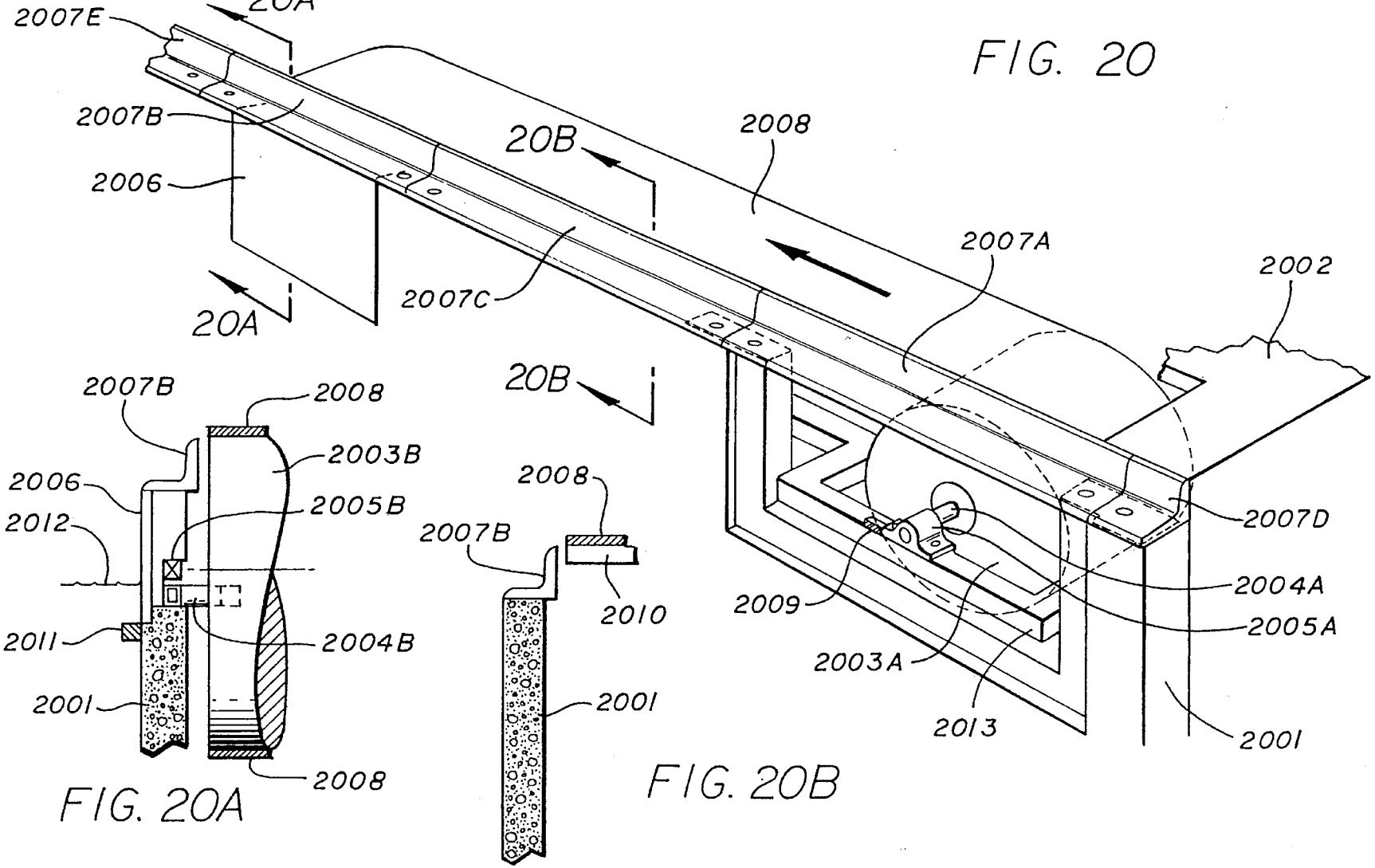
FIG. 20 is a perspective diagram illustrating the preferred embodiment of the dock assembly of the present invention.

FIG. 20 is a perspective diagram illustrating the preferred embodiment of the dock assembly of the present invention. Dock surface 2008 is a belt that travels around roller 2003A and a similar roller located at the opposite end of the dock. Roller 2003A rotates around axle 2004A, which is mounted in bearing 2005A. Bearing 2005A is mounted on frame 2013. The tension of dock surface 2008 may be adjusted by changing the position of bearing 2005A relative to frame 2013 using adjustment mechanism 2009. Frame 2013 is coupled to wall 2001, which separates roller 2003A, axle 2004A, bearing 2005A, and axle 2013 from the water on the opposite side of wall 2001. Portions of wall 2001 are cut out to allow access to the rollers, axles, bearings, and belt for repair and maintenance. Plates such as plate 2006 may be used to seal access holes to keep water from entering. Rails 2007A, 2007B, 2007C, 2007D, and 2007E run along the top edge of wall 2001 and the top edge of plates such as plate 2006. Stationary deck surface 2002 surrounds the periphery of the upper substantially horizontal portion of deck surface 2008.

FIG. 20 also includes inset diagram A—A, which illustrates a cross sectional view of an embodiment of the dock assembly. Dock surface 2008 is a belt that travels around roller 2003B. Roller 2003B rotates around axle 2004B. Axle 2004B is mounted in bearing 2005B. Bearing 2005B is mounted on wall 2001. Bumper 2011 is attached to wall 2001. Plate 2006 covers axle 2004B, bearing 2005B, and a portion of the side of roller 2003B. Rail 2007B abuts the top of plate 2006 and covers a portion of the side of roller 2003B. Plate 2006 extends above water line 2012 to prevent ingress of water.

FIG. 20 further includes inset diagram B—B, which illustrates a cross sectional view of an embodiment of the dock assembly of the present invention. Wall 2001 extends above the water line, and rail 2007B is mounted on the top edge of wall 2001. Support plate 2010 lies beneath dock surface 2008 to prevent excessive downward excursion of dock surface 2008 between the rollers.

By rotating the rollers, the upper surface of dock surface 2008 may be made to move in a direction parallel to rails 2007A, 2007B, 2007C, 2007D, and 2007E. If passengers stand on dock surface 2008, they may be moved along the boat at the dock to allow easy boarding and disembarking. If the speed of dock surface 2008 is made to match the speed of the docking boat, there will be no relative motion between dock surface 2008 and the docking boat, thereby avoiding difficulties associated with a speed differential.

Thus, a vehicle that provides safe and stable transportation of passengers, yet allows passengers, including wheelchair-bound passengers, to quickly enter and exit the vehicle without climbing down into the vehicle and without stepping on the seats has been provided.

We claim:

1. A method for passenger loading and unloading comprising the step of:

changing a vertical displacement of an inner portion of a vehicle relative to an outer portion of said vehicle by causing said vehicle to pass over a cam structure.

2. The method of claim 1 wherein said inner portion is raised relative to said outer portion.

3. The method of claim 1 wherein said inner portion is supported above said cam structure by a leg and wheel assembly, said leg and wheel assembly causing said inner portion of said vehicle to pass over said cam structure.

4. A method for loading a passenger into a vehicle, the method comprising the steps of:

supporting an inner hull of said vehicle by a leg and wheel assembly attached to said inner hull;

causing said leg and wheel assembly to pass over a cam structure;

raising said inner hull with respect to an outer hull of said vehicle in response to said leg and wheel assembly passing over said cam structure;

loading a passenger into said vehicle when said inner hull is raised with respect to said outer hull.

5. An amusement ride comprising:

a vehicle having an outer portion and an inner portion;

a cam structure for inducing relative motion between said outer portion and said inner portion to allow passengers to enter and exit said vehicle;

a plurality of cables coupled between said inner portion and said outer portion of said vehicle for stabilizing said outer portion.

* * * * *